US008211826B2

(12) United States Patent
Keeton et al.

(10) Patent No.: US 8,211,826 B2
(45) Date of Patent: Jul. 3, 2012

(54) TWO-SIDED THERMAL MEDIA

(75) Inventors: Mark E. Keeton, Kettering, OH (US); Yaoping Tan, Lebanon, OH (US); Matthew A. McLaughlin, Franklin, OH (US); Jeffery S. Denton, Springboro, OH (US); Timothy W. Rawlings, Waynesville, OH (US); Richard D. Puckett, Miamisburg, OH (US); Paul C. Blank, LaCrosse, WI (US)

(73) Assignee: NCR Corporation, Duluth, GA (US)

( * ) Notice: Subject to any disclaimer, the term of this patent is extended or adjusted under 35 U.S.C. 154(b) by 1234 days.

(21) Appl. No.: 11/834,411

(22) Filed: Aug. 6, 2007

(65) Prior Publication Data

US 2009/0017236 A1 Jan. 15, 2009

Related U.S. Application Data

(63) Continuation-in-part of application No. 11/780,959, filed on Jul. 20, 2007, now Pat. No. 7,531,224, and a continuation-in-part of application No. 11/779,732, filed on Jul. 18, 2007.

(60) Provisional application No. 60/949,378, filed on Jul. 12, 2007.

(51) Int. Cl.
*B41M 5/30* (2006.01)

(52) U.S. Cl. ..... 503/226; 428/32.51; 503/200

(58) Field of Classification Search ..... None
See application file for complete search history.

(56) References Cited

U.S. PATENT DOCUMENTS

| | | | |
|---|---|---|---|
| 3,947,854 | A | 3/1976 | Hansen et al. |
| 4,167,392 | A | 9/1979 | Defago |
| RE30,116 | E | 10/1979 | Maalouf |
| 4,309,255 | A | 1/1982 | Gendler et al. |
| 4,507,669 | A | 3/1985 | Sakamoto et al. |
| 4,708,500 | A | 11/1987 | Bangs et al. |
| 4,956,251 | A | 9/1990 | Washizu et al. |
| 4,965,166 | A | 10/1990 | Hosoi et al. |
| 5,055,373 | A | 10/1991 | Saeki et al. |
| 5,101,222 | A | 3/1992 | Hakkaku |

(Continued)

FOREIGN PATENT DOCUMENTS

| | | |
|---|---|---|
| EP | 0947340 | 10/1999 |

(Continued)

OTHER PUBLICATIONS

JP Abstract, vol. 007, No. 063 (M-200) , Mar. 16, 1983 & JP 57-208298 A (Ricoh KK) , Dec. 21, 1982.

(Continued)

*Primary Examiner* — Bruce H Hess
(74) *Attorney, Agent, or Firm* — Charles Q. Maney; Dana T. Hustins

(57) ABSTRACT

Two-sided thermal media comprising thermal transfer receptive and/or direct thermal thermally sensitive coatings on one or both of a first and a second side thereof are provided. In one embodiment, two-sided thermal media comprising a substrate having a first side and a second side, opposite the first side, and a first and a second thermal transfer receptive coating supported on the respective first and second substrate sides is provided. In another embodiment, two-sided thermal media comprising a substrate having a thermal transfer receptive coating on a first side thereof, and a direct thermal thermally sensitive coating on a second side thereof, is provided. In some embodiments, a direct thermal thermally sensitive coating provided on one or both sides of two-sided thermal media is adapted to image at a temperature different than a temperature at which thermal transfer printing has or can occur.

28 Claims, 12 Drawing Sheets

U.S. PATENT DOCUMENTS

| | | | |
|---|---|---|---|
| 5,132,704 | A | 7/1992 | Nakagawa |
| 5,196,297 | A | 3/1993 | Dombrowski, Jr. et al. |
| 5,214,750 | A | 5/1993 | Minowa et al. |
| 5,266,550 | A | 11/1993 | Asajima et al. |
| 5,284,816 | A | 2/1994 | Stephenson |
| 5,398,305 | A | 3/1995 | Yawata et al. |
| 5,428,714 | A | 6/1995 | Yawata et al. |
| 5,437,004 | A | 7/1995 | Miyasaka et al. |
| 5,555,349 | A | 9/1996 | Miyasaka et al. |
| 5,584,590 | A | 12/1996 | Ito et al. |
| 5,594,653 | A | 1/1997 | Akiyama et al. |
| 5,629,259 | A | 5/1997 | Akada et al. |
| 5,639,169 | A | 6/1997 | Aruga |
| 5,667,303 | A | 9/1997 | Arens et al. |
| 5,677,722 | A | 10/1997 | Park |
| 5,692,110 | A | 11/1997 | Miyasaka et al. |
| 5,707,925 | A | 1/1998 | Akada et al. |
| 5,710,094 | A | 1/1998 | Minami et al. |
| 5,755,521 | A | 5/1998 | Ito et al. |
| 5,756,188 | A | 5/1998 | Reiter et al. |
| 5,763,356 | A | 6/1998 | Ueno et al. |
| 5,789,340 | A | 8/1998 | Brust et al. |
| 5,792,725 | A | 8/1998 | Simpson et al. |
| 5,794,530 | A | 8/1998 | Dobashi et al. |
| 5,800,081 | A | 9/1998 | Teradaira et al. |
| 5,815,191 | A | 9/1998 | Michielsen et al. |
| 5,846,900 | A | 12/1998 | Reiter et al. |
| 5,876,836 | A | 3/1999 | Imamura et al. |
| 5,883,043 | A | 3/1999 | Halbrook, Jr. et al. |
| 5,886,725 | A | 3/1999 | Miyadera et al. |
| 5,918,910 | A | 7/1999 | Stillwagon et al. |
| 5,964,541 | A | 10/1999 | Murison et al. |
| 6,095,414 | A | 8/2000 | Long et al. |
| 6,130,185 | A | 10/2000 | Narita et al. |
| 6,150,067 | A | 11/2000 | Koike et al. |
| 6,210,777 | B1 | 4/2001 | Vermeulen et al. |
| 6,388,692 | B1 | 5/2002 | Iwata et al. |
| 6,524,000 | B1 | 2/2003 | Roth |
| 6,544,925 | B1 | 4/2003 | Prusik et al. |
| 6,562,755 | B1 | 5/2003 | Halbrook, Jr. et al. |
| 6,759,366 | B2 | 7/2004 | Beckerdite et al. |
| 6,784,906 | B2 | 8/2004 | Long et al. |
| 6,801,233 | B2 | 10/2004 | Bhatt et al. |
| 6,906,735 | B2 | 6/2005 | Bhatt et al. |
| 2003/0114301 | A1 | 6/2003 | Beckerdite et al. |
| 2004/0084631 | A1 | 5/2004 | Spoonhower et al. |
| 2005/0020387 | A1 | 1/2005 | Kennedy, III |
| 2005/0164881 | A1 | 7/2005 | Kenney et al. |
| 2006/0159503 | A1 | 7/2006 | Janning |
| 2006/0289633 | A1 | 12/2006 | Moreland et al. |
| 2007/0120942 | A1 | 5/2007 | Van Demark et al. |

FOREIGN PATENT DOCUMENTS

| | | |
|---|---|---|
| GB | 2250478 | 6/1992 |
| WO | WO 2004/077001 A1 | 9/2004 |

OTHER PUBLICATIONS

JP Abstract, vol. 007, No. 081 (M-105), Apr. 5, 1983 & JP 58-008668 A (Shinko Denki KK), Jan. 18, 1983.

JP Abstract, Vo. 015, No. 194 (M-1114), May 20, 1991 & JP 03-051149 A (Fujitsu General. Ltd.), Mar. 5, 1991.

JP Abstract, vol. 2000, No. 24 May 11, 2001 & JP 2001-199095 A (Alps Electric Co. Ltd.), Jul. 24, 2001.

JP Abstract, vol. 1998, No. 8, Jun. 30, 1998 & JP 10-076713 A (Sony Corp.) Mar. 24, 1998.

JP Abstract, vol. 10; No. 151 (M-483), May 31, 1986 & JP 61-003765 A (Konishiroku Shashin Kogyo KK), Jan. 9, 1986.

JP Abstract, vol. 16, No. 041 (M-1206), Jan. 31, 1992 & JP 03-246091 A (Canon Inc.), Nov. 1, 1991.

Boca Systems Micro Plus 2S 2 Sided Printer product brochure which came to the attention of Applicant at a Chicago tradeshow during the summer of 2002.

APTi PowerEcoT R2412 printer brochure, which was came to the attention of Applicant in the summer of 2007, and was translated by Applicant's Japanese Office in the fall of 2007.

TWO-SIDED THERMAL MEDIA

CROSS REFERENCE TO RELATED APPLICATIONS

This application claims priority to U.S. Provisional Application No. 60/949,378 entitled "Two-Sided Thermal Printing" and filed on Jul. 12, 2007, and is a continuation in part of U.S. application Ser. No. 11/779,732 entitled "Two-Sided Thermal Printer" and filed on Jul. 18, 2007 and U.S. application Ser. No. 11/780,959 entitled "Two-Sided Thermal Transfer Ribbon" and filed on Jul. 20, 2007, now U.S. Pat. No. 7,531,224, the contents of which are hereby incorporated by reference herein.

BACKGROUND

Dual, or two-sided printing comprises the simultaneous or near simultaneous printing or imaging of a first side and a second side of print media, opposite the first side. Two-sided direct thermal printing of media comprising a document such as a transaction receipt is described in U.S. Pat. Nos. 6,784,906 and 6,759,366 the contents of which are hereby incorporated by reference herein. In two-sided direct thermal printing, a two-sided direct thermal printer is configured to allow concurrent printing on both sides of two-sided thermal media moving along a media feed path through the printer. In such printers a thermal print head is disposed on each of two sides of the media for selectively applying heat to one or more thermally sensitive coatings thereon. The coatings change color when heat is applied, by which printing is provided on the respective sides.

SUMMARY

Two-sided thermal media comprising thermal transfer receptive and/or direct thermal thermally sensitive coatings on one or both of a first and a second side thereof are provided. In one embodiment, two-sided thermal media comprising a substrate having a first side and a second side, opposite the first side, and a first and a second thermal transfer receptive coating supported on the respective first and second substrate sides is provided. In another embodiment, two-sided thermal media comprising a substrate having a thermal transfer receptive coating on a first side thereof, and a direct thermal thermally sensitive coating on a second side thereof, is provided. In some embodiments, a direct thermal thermally sensitive coating provided on one or both sides of two-sided thermal media is adapted to image at a temperature different than a temperature at which thermal transfer printing has or can occur. Additional variations are also provided.

DETAILED DESCRIPTION

By way of example, various embodiments of the invention are described in the material to follow with reference to the included drawings. Variations may be adopted.

Figure 1:
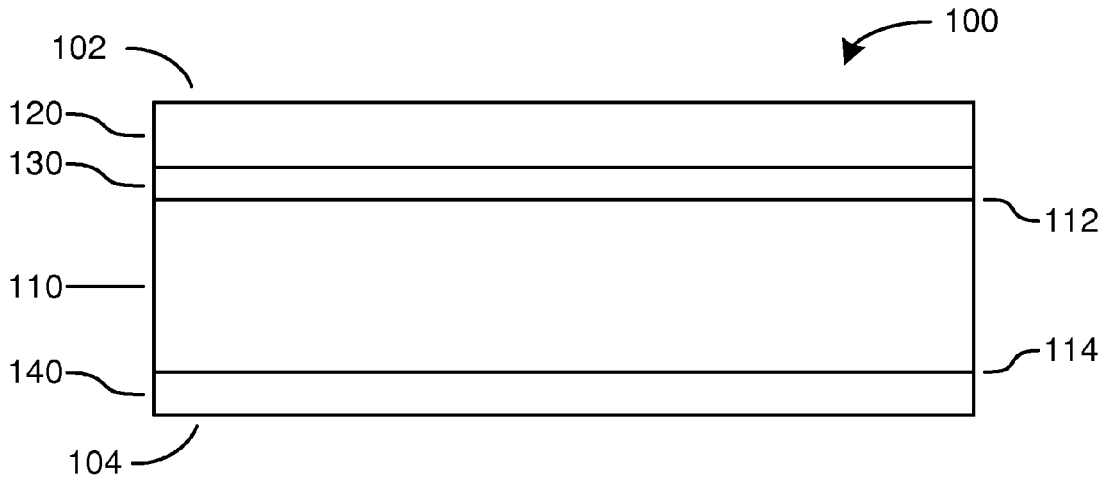
FIG. 1 provides a cross-sectional view of one-sided thermal transfer ribbon for, inter alia, thermal transfer printing of media such as transaction receipts, tickets, labels, and other documents.

FIG. 1 illustrates a one-sided thermal transfer ribbon 100 for thermal transfer printing of media such as transaction receipts, tickets, labels, and other documents. As shown in FIG. 1, a one-sided thermal transfer ribbon 100 may comprise a substrate 110 with a functional coat 120 on a first side 112 thereof and a back coat 114 on a second side thereof. The substrate 110 may comprise a fibrous or film type sheet for supporting the functional coating 120. Additionally, the substrate 110 may be natural (e.g., cellulose, cotton, starch, and the like) or synthetic (e.g., polyethylene, polyester, polypropylene, and the like). In one embodiment, the substrate 110 is provided in the form of an 18 gauge polyethylene terephthalate (PET) film.

A functional coating 120 of a one-sided thermal transfer ribbon 100 may comprise a dye and/or pigment bearing substance which is transferred to receptive media (e.g., cardboard, paper, film, and the like) upon application of heat, by which printing is provided. A functional coating 120 may comprise a wax (e.g., carnauba, paraffin, and the like), resin (e.g., urethane, acrylic, polyester, and the like), or a combination of the two, having one or more dyes (e.g., a leuco dye, methyl violet, and the like) and/or pigments (e.g., carbon black, iron oxide, inorganic color pigments, and the like) incorporated therein. In one embodiment, a functional coating 120 comprising 65-85% carnauba and/or paraffin wax, 5-20% carbon black pigment, and 5-15% ethylene vinyl acetate (EVA) resin is provided. In a further embodiment, a functional coating 120 comprising 40% carnauba, 40% paraffin wax, 15% carbon black pigment, and 5% ethylene vinyl acetate (EVA) resin is provided Where applied, a back coat 140 of a one-sided thermal transfer ribbon 100 may protect the substrate 110 from damage due to application of heat for printing (e.g., warping, curling, melting, burn-thru, and the like), mitigate against bonding of a functional coated side 102 of a one-sided thermal transfer ribbon 100 to a back side 104 thereof when such ribbon 100 is provided in, for example, roll form, and/or provide a low friction (re. slippery) surface to ease travel over and mitigate damage to an associated print head.

A typical back coat 140 is silicone and/or silane based (either mobile or cured), which provides desired thermal stability under print (re. hot) conditions, and a low coefficient of friction (re. slippery). In one embodiment, a back coat 140 comprises a water based or ultra-violet (UV) light cured silicone.

As further shown in FIG. 1, a one-sided thermal transfer ribbon may further comprise a sub coat 130 between the substrate 110 and the functional coating 120. Where provided, the sub coat 130 may aid in adhering and/or releasing the functional coating 120 to and/or from the substrate 110. A sub coat 130 may comprise a wax (e.g., carnauba, paraffin, and the like), resin (e.g., urethane, acrylic, polyester, and the like), or a combination of the two, and may include one or more release and/or slip agents (e.g., polytetrafluoroethylene (PTFE), silicone, and the like). In one embodiment, a sub coat 130 comprises 60% carnauba wax, 30% paraffin wax, and 10% PTFE.

Figure 2:
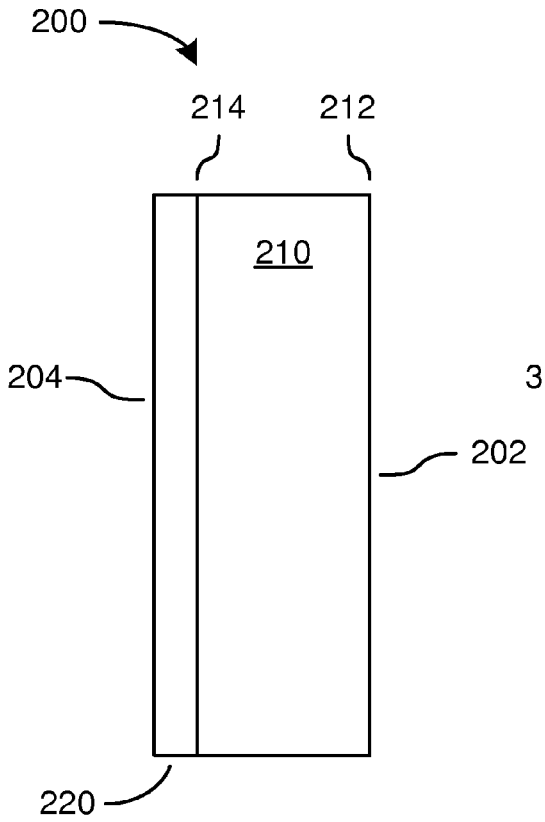
FIG. 2 provides a cross-sectional view of one-sided thermal transfer media for use as, inter alia, a transaction receipt, ticket, label, or other document.

FIG. 2 illustrates one-sided thermal transfer media 200 for use as a transaction receipt, ticket, label, or other document. As shown in FIG. 2, one-sided thermal transfer media 200 may comprise a substrate 210 supporting a thermal transfer receptive coating 220 on a first side 214 thereof. The substrate 210 may comprise a fibrous or film type sheet either or both of which may comprise one or more natural (e.g., cellulose, cotton, starch, and the like) and/or synthetic (e.g., polyethylene, polyester, polypropylene, and the like) materials. In one embodiment, the substrate 210 is provided in the form of a non-woven cellulosic (e.g., paper) sheet.

The thermal transfer receptive coating 220 of one-sided thermal transfer media 200 may comprise one or more materials for preparing a respective printing surface 204 of the media 200 to accept transfer of a functional coating 120 from a thermal transfer ribbon 100. Such thermal transfer receptive coating 220 may comprise a clay (e.g., kaolinite, montmorillonite, illite, and chlorite), resin (e.g., urethane, acrylic, polyester, and the like), or a combination thereof, with or without a binder (e.g., polyvinyl acetate (PVA)), which coating 220 may further be prepared to a desired or required surface finish and/or smoothness post-application. In one embodiment, a thermal transfer receptive coating 220 comprising 90% clay and 10% PVA (as-dried) calendared to a smoothness of greater than approximately 300 Bekk seconds is provided on a first side 214 of a non-woven cellulosic substrate 210 comprising one-sided thermal transfer media 200.

Figure 3:
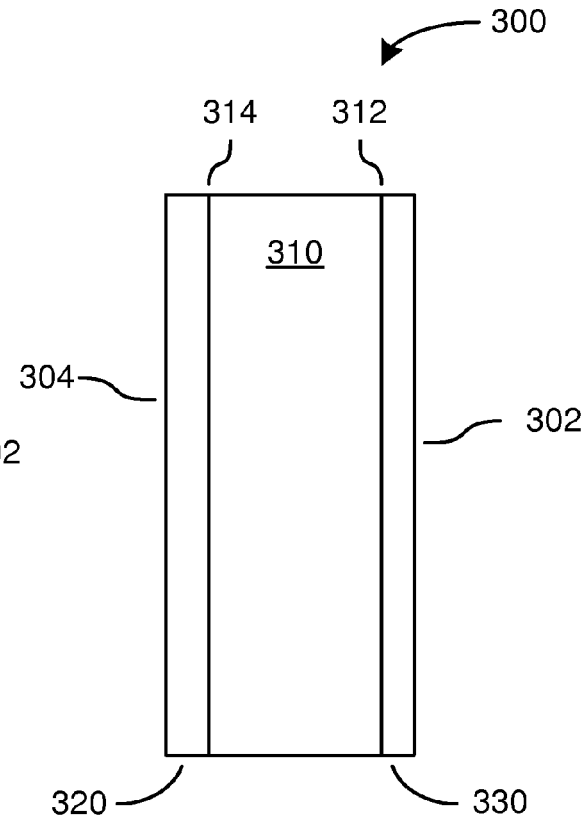
FIG. 3 provides a cross-sectional view of two-sided thermal transfer media for use as, inter alia, a transaction receipt, ticket, label, or other document.

FIG. 3 illustrates two-sided thermal transfer media 300 for use as, for example, a one- or two-sided transaction receipt, ticket, label, or other document. As shown in FIG. 3, two-sided thermal transfer media 300 may comprise a substrate 310 supporting a thermal transfer receptive coating 320 on a first side 314 thereof. The substrate 310 may comprise a fibrous or film type sheet either or both of which may comprise one or more natural (e.g., cellulose, cotton, starch, and the like) and/or synthetic (e.g., polyethylene, polyester, polypropylene, and the like) materials. In one embodiment, the substrate 310 is provided in the form of a biaxially-oriented polypropylene (BOPP) sheet.

The thermal transfer receptive coatings 320, 330 of the two-sided thermal transfer media 300 may comprise one or more materials for preparing a respective printing surface 302, 304 of the media 300 to accept transfer of a functional coating 120 from a thermal transfer ribbon 100. Such coatings 320, 300 may comprise a clay (e.g., kaolinite, montmorillonite, illite, and chlorite), resin (e.g., urethane, acrylic, polyester, and the like), or a combination thereof, either or both of which coatings 320, 330 may further be prepared to a desired or required surface finish and/or smoothness post-application. In one embodiment, thermal transfer receptive coatings 320, 330 each comprising 100% acrylic and calendared to a smoothness of greater than approximately 300 Bekk seconds are provided on respective sides 314, 312 of a BOPP substrate 310 comprising the two-sided thermal transfer media 300.

Figure 4:
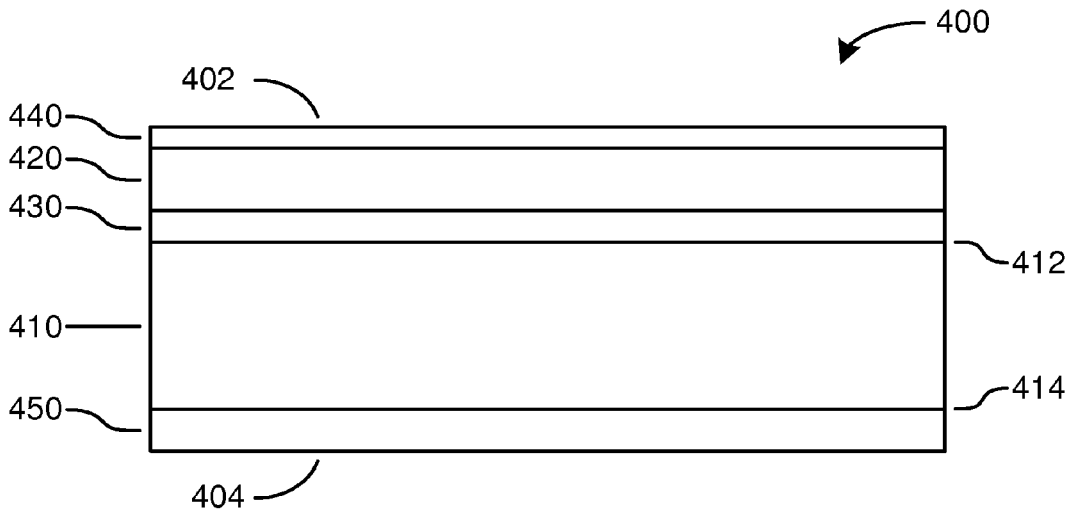
FIG. 4 provides a cross-sectional view of one-sided direct thermal media for use as, inter alia, a transaction receipt, ticket, label, or other document.

FIG. 4 illustrates a cross-sectional view of one-sided direct thermal media 400 for use as a transaction receipt, ticket, label, or other document. As shown in FIG. 4, one-sided direct thermal media 400 may comprise a substrate 410 having a thermally sensitive coating 420 on a first side 412 thereof. As for the one-sided thermal transfer media 200 illustrated in FIG. 2, the substrate 410 of one-sided direct thermal media may comprise a fibrous or film type sheet either or both of which may comprise one or more natural (e.g., cellulose, cotton, starch, and the like) and/or synthetic (e.g., polyethylene, polyester, polypropylene, and the like) materials. In one embodiment, the substrate 410 is provided in the form of a non-woven cellulosic (e.g., paper) sheet.

A thermally sensitive coating 420 may comprise at least one dye and/or pigment, and optionally, may include one or more activating agents which undergo a color change upon the application of heat by which printing is provided. In one embodiment, a dye-developing type thermally sensitive coating comprising a leuco-dye (e.g., 3,3-bis(p-dimethylaminophenyl)-phthalide, 3,3-bis(p-dimethylaminophenyl)-6-dimethylaminophthalide, 3-cyclohexylamino-6chlorofluoran, 3-(N—N-diethylamino)-5-methyl-7-(N,N-Dibenzylamino)flouran, and the like), a developer (e.g., 4,4'-isopropylene-diphenol, p-tert-butylphenol, 2-4-dinitrophenol, 3,4-dichiorophenol, p-phenylphenol, 4,4-cyclohexylidenediphenol, and the like), and an optional sensitizer (e.g., acetamide, stearic acid amide, linolenic acid amide, lauric acid amide, and the like) as disclosed in U.S. Pat. No. 5,883,043 to Halbrook, Jr., et al. the contents of which are hereby incorporated by reference herein, is provided.

As further illustrated in FIG. 4, one-sided direct thermal media 400 may further comprise a sub coat 430, a top coat 440 and a back coat 450. Where provided, a sub coat 430 may be included as a buffer region between a first surface 412 of a substrate 410 and a thermally sensitive coating 420 to avoid adverse interaction of chemicals and/or impurities from the substrate 410 with the thermally sensitive coating 420, and thereby avoid undesired and/or premature imaging. Further, a sub coat 430 may be provided to prepare an associated surface 412 of a substrate 410 for reception of a thermally sensitive coating 420, such as by providing for a desired or required surface finish or smoothness. Suitable sub coats 430 include clay and/or calcium carbonate based coatings. In one embodiment, a clay based sub coat 430 is applied to a first surface of a cellulosic substrate 410 and calendared to a smoothness of greater than approximately 300 Bekk seconds prior to application of an associated thermally sensitive coating 420 comprising one or more leuco dyes, developers and sensitizers.

A top coat 440 may be provided over a thermally sensitive coating 420 to protect the thermally sensitive coating and/or any resultant image from mechanical (e.g., scratch, smudge, smear, and the like) and/or environmental (chemical, UV, and the like) degradation. Likewise, a top coat 440 may be provided to enhance slip between the thermally sensitive coated side 102 of one-sided thermal media 400 and various components of a thermal printer such as, but not limited to a thermal print head. A top coat 440 may include any suitable components that serve to protect or enhance the performance and/or properties of a thermally sensitive layer 420 such as one or more polymers, monomers, UV absorbers, scratch inhibitors, smear inhibitors, slip agents, and the like. In one embodiment, a top coat 440 comprising a zinc stearate is provided over a thermally sensitive coating 420 in the form of a leuco dye/developer system.

One-sided direct thermal media 400 may further comprise a back coat 450 on a second side 414 of a substrate 410 to, inter alia, mitigate against mechanical and/or environmental damage to the substrate 410 and/or thermally sensitive coating 420, as well as provide for desirable mechanical and/or physical properties (e.g., slip, release, tear, adhesive, permeability, water resistance, UV absorbing, smoothness, and the like). In one embodiment, a calcium carbonate based back coat 450 is provided for acceptance of ink jet printing thereon.

Figure 5:
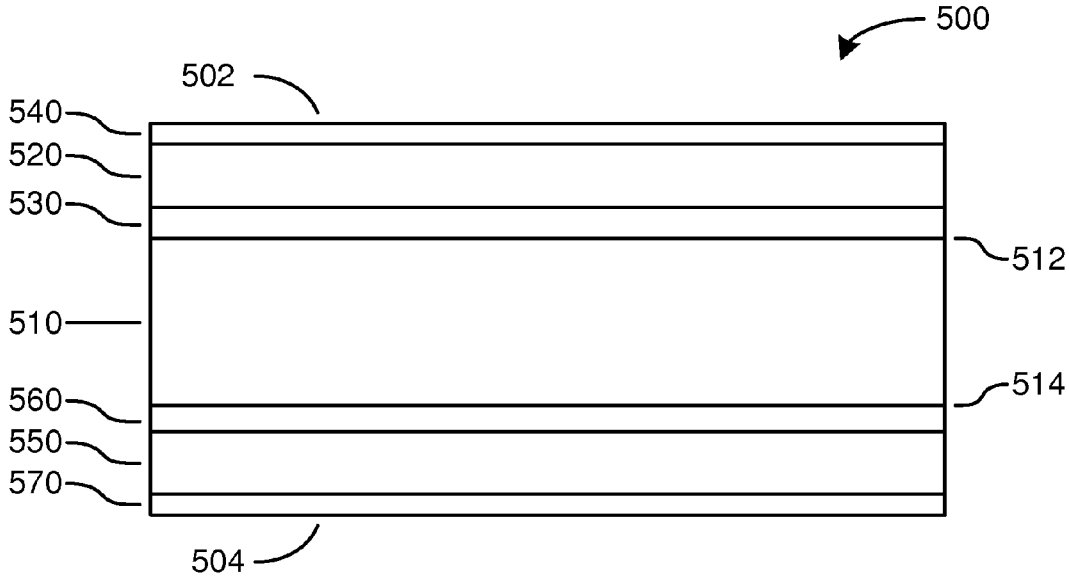
FIG. 5 provides a cross-sectional view of two-sided direct thermal media for use as, inter alia, a transaction receipt, ticket, label, or other document.

FIG. 5 illustrates a cross-sectional view of two-sided direct thermal media 500 for use as a transaction receipt, ticket, label, or other document. As shown in FIG. 5, two-sided direct thermal media 500 may comprise a substrate 510 having a first and a second thermally sensitive coating 520, 550 on a first and a second side 512, 514 thereof. As for one-sided direct thermal media 400, the substrate 510 of two-sided direct thermal media 500 may comprise a fibrous or film type sheet either or both of which may comprise one or more natural (e.g., cellulose, cotton, starch, and the like) and/or synthetic (e.g., polyethylene, polyester, polypropylene, and the like) materials. In one embodiment, the substrate 510 is provided in the form of a spunbonded high density polyethylene sheet.

The thermally sensitive coating 520, 550 may comprise at least one dye and/or pigment, and optionally, may include one or more activating agents which undergo a color change upon the application of heat by which printing is provided. In one embodiment, dye-developing type thermally sensitive coatings 520, 550 comprising one or more leuco-dyes, developers, and, optionally, one or more sensitizers, as described hereinabove, are provided.

As further illustrated in FIG. 5, two-sided direct thermal media 500 may further comprise a sub coat 530, 560 between a first and a second surface 512, 514 of a substrate 510 and a respective first and second thermally sensitive coating 520, 550 in order to, inter alia, avoid adverse interaction of chemicals and/or impurities from the substrate 510 with the thermally sensitive coatings 520, 550. Additionally, one or more sub coats 530, 560 may be provided to prepare an associated surface 512, 514 of a substrate 510 for reception of a respective thermally sensitive coating 520, 550 such as by providing for a desired or required surface finish or smoothness. Suitable sub coats 530, 550 include clay and/or calcium carbonate based coatings. In one embodiment, clay based sub coats 530, 560 are applied to respective first and second surfaces 512, 514 of a spunbonded high density polyethylene substrate 510, and calendared to a smoothness of greater than approximately 300 Bekk seconds prior to application of associated thermally sensitive coatings 520, 550 comprising one or more leuco dyes, developers and sensitizers.

Finally, as additionally shown in FIG. 5, two-sided direct thermal media 500 may comprise one or more top coats 540, 570 over respective thermally sensitive coatings 520, 550 in order to, inter alia, protect the thermally sensitive coating and/or any resultant image from mechanical (e.g., scratch, smudge, smear, and the like) and/or environmental (chemical, UV, and the like) degradation. Likewise, one or more top coats 540, 570 may be provided to enhance slip between a respective side 502, 504 of two-sided thermal media 500 and various components of a thermal printer such as, but not limited to respective thermal print heads. A top coat 540, 570 may include any suitable components that serve to protect or enhance the performance and/or properties of a thermally sensitive layer 520, 550 such as one or more polymers, monomers, UV absorbers, scratch inhibitors, smear inhibitors, slip agents, and the like. In one embodiment, first and second top coats 540, 570 comprising varnish are provided over first and second thermally sensitive coatings 520, 550 in the form of leuco dye/developer systems comprising two-sided direct thermal media 500.

Depending on the application, a first thermally sensitive coating 520 may have a dye and/or co-reactant chemical which activates at a different temperature than the dye and/or co-reactant chemical present in the second coating 550. Alternatively or additionally, a substrate 510 of two-sided direct thermal media 500 may have sufficient thermal resistance to prevent heat applied to one coating 520, 550 from activating the dye and/or co-reactant chemical in the other coating 550, 520, as disclosed in U.S. Pat. No. 6,759,366 to Beckerdite et al. the contents of which are hereby incorporated herein by reference.

Figure 6A:
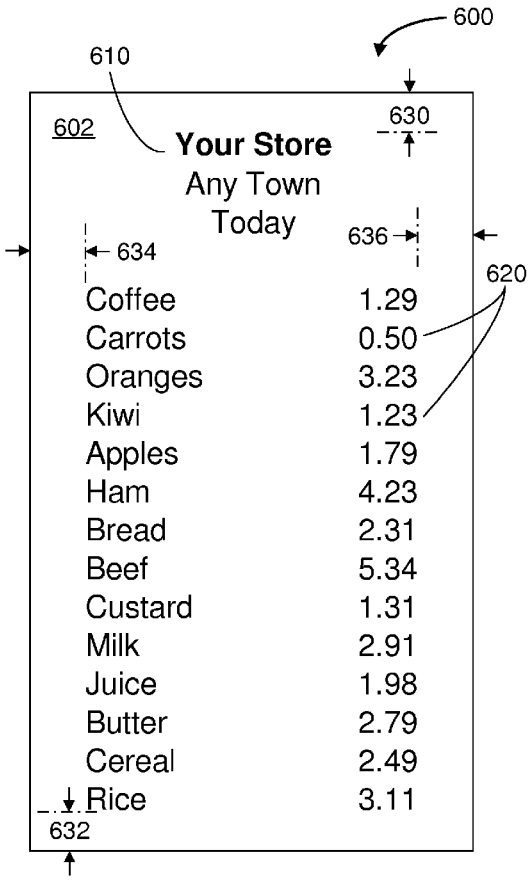
FIG. 6A illustrates a first side of a two-sided thermal document in the form of a transaction receipt.
Figure 6B:
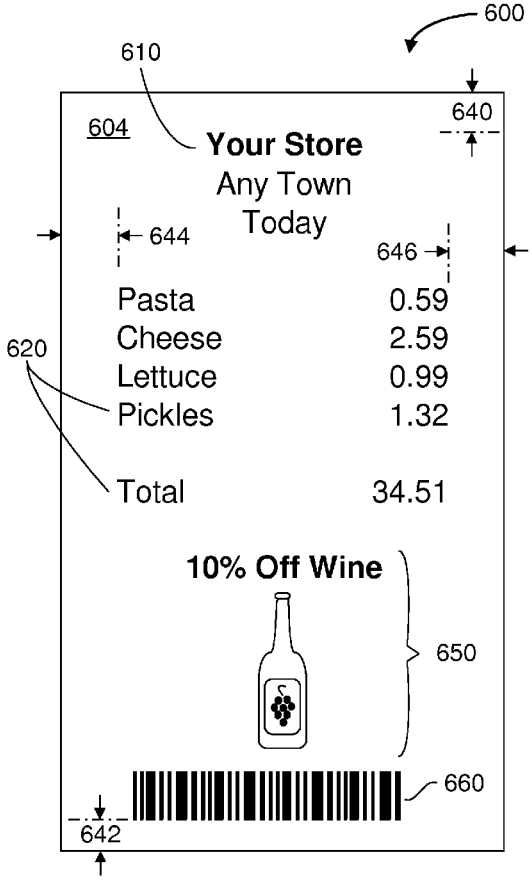
FIG. 6B illustrates a second side of a two-sided thermal document in the form of a transaction receipt.

FIGS. 6A and 6B illustrate respective first and second sides 602, 604 of a two-sided thermal document in the form of a transaction receipt 600. As shown in FIGS. 6A and 6B, a two-sided receipt 600 may comprise a header 610 printed on one or both sides 602, 604 of the receipt 600, along with respective first and second portions of transaction information 620 comprising the receipt 600.

Additionally, one or both sides 602, 604 of a two-sided receipt 600 may comprise additional text and/or graphic information desired or required to be printed such as, but not limited to, one or more of a logo, a serialized cartoon, a condition of sale, an advertisement, a security feature, rebate or contest information, ticket information, legal information such as a disclaimer or a warranty, and the like. As shown in FIG. 6B, such additional information may comprise a discount offer 650 and a bar code 660.

As further shown in FIGS. 6A and 6B, a first side 602 of a two-sided receipt 600 may further comprise a top margin 630, a bottom margin 632, a left margin 634, and a right margin 636. Likewise, a second side 604 of a two-sided receipt 600 may further comprise a top margin 640, a bottom margin 642, a left margin 644, and a right margin 646, some or all of which may also be the same size as, or independently sized in regard to the respective margins 630, 632, 634, 636 provided on the first side 602 of the two-sided receipt 600.

Figure 7:
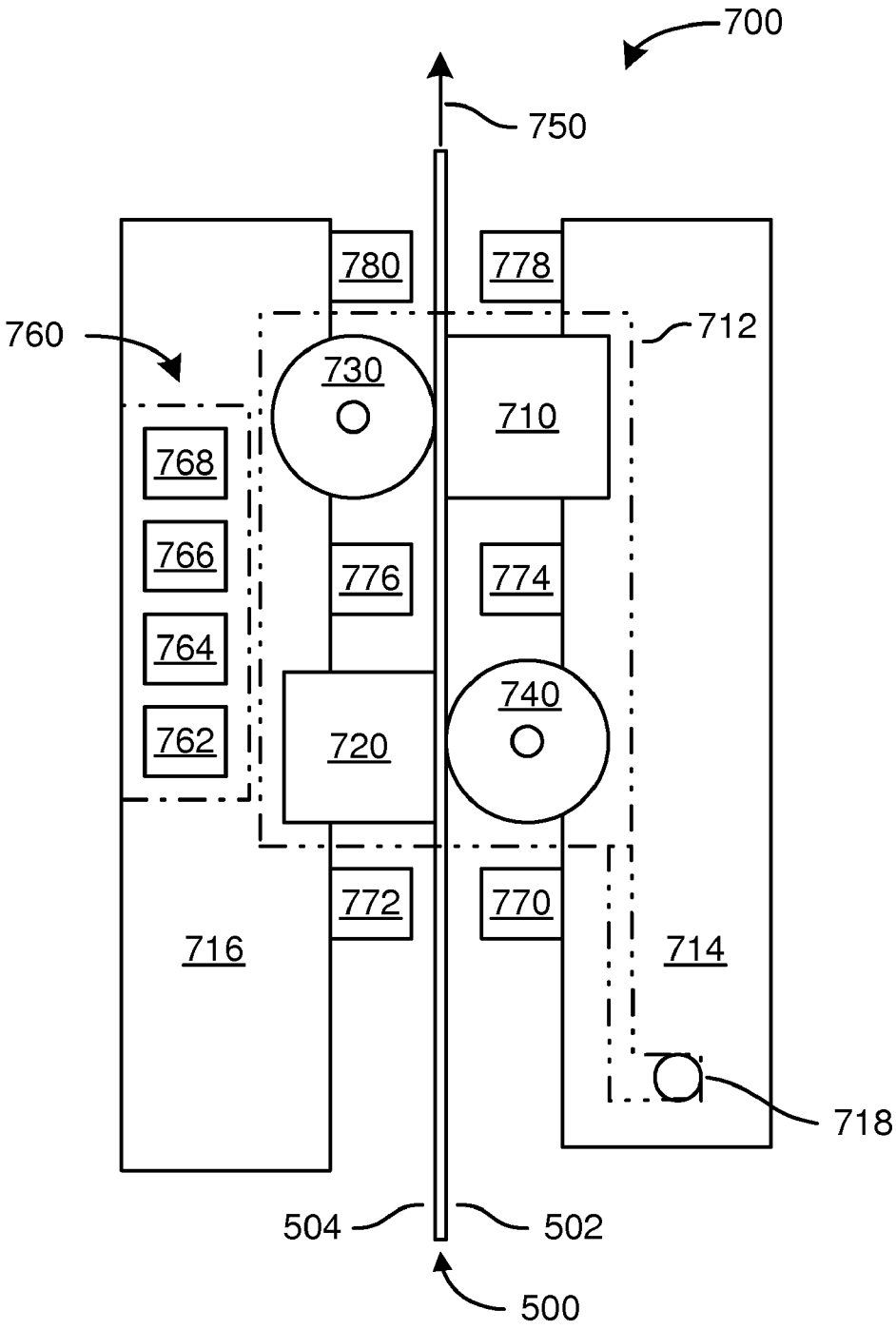
FIG. 7 provides a schematic of a two-sided direct thermal printer.

FIG. 7 illustrates a two-sided direct thermal printer 700 for direct thermal printing of direct thermal media such as the one- or two-sided direct thermal media 400, 500 of FIGS. 4 and 5. As shown in FIG. 7, a two-sided direct thermal printer 700 may comprise first and second thermal print heads 710, 720 for printing on respective sides 402, 502, 504 of one- or two-sided media 400, 500 moving along a media feed path 750. Additionally, first and second platens 730, 740 may be provided on opposite sides of the media 400, 500 and feed path 750 thereof proximate to the first and second print heads 710, 720 in order to, for example, maintain contact between the first and second print heads 710, 720 and a respective first and second side 402, 404, 502, 504 of the media 400, 500.

Depending on the printer design and/or application, the media 400, 500 may be supplied in the form of a roll, fan-fold stock, individual (cut) sheets, and the like, upon which information in text and/or graphic form may be printed on one or both sides thereof to provide, for example, a voucher, coupon, receipt, ticket, label or other article or document. In one embodiment, a two-sided direct thermal printer 700 comprises first and second thermal print heads 710, 720, and first and second rotating platens 730, 740 to facilitate printing on one or both sides of one- or two-sided direct thermal media 400, 500 provided in roll form, such as a model 7168 two-sided multifunction printer sold under the RealPOS trademark by NCR Corporation.

As shown in FIG. 7, a two-sided direct thermal printer 700 may further include a controller 760 for controlling operation of the printer 700. The controller 760 may comprise a communication controller 762, one or more buffers or memory elements 764, a processor 766, and/or a printing function switch 768. The communication controller 762 may provide for receiving and/or sending print commands and/or data to and from a host computer or terminal such as a point-of-sale (POS) terminal (not shown), an automated teller machine (ATM) (not shown), a self-checkout system (not shown), a personal computer (not shown), and the like, associated with the printer 700. The communications controller 762 may provide for input of data to, or output of data from, the printer 700 pursuant to one or more wired (e.g., parallel, serial/USB, Ethernet, etc) and/or wireless (e.g., 802.11, 802.15, IR, etc) communication protocols, among others.

Where provided, the one or more buffers or memory elements 764 may provide for short or long term storage of received print commands and/or data. As such, the one or more buffer or memory elements 764 may comprise one or more volatile (e.g., dynamic or static RAM) and/or non-volatile (e.g., EEPROM, flash memory, etc) memory elements. In one embodiment, a two-sided direct thermal printer 700 includes a first and a second memory element or storage area 764 wherein the first memory element or storage area 764 is adapted to store data identified for printing by one of the first and the second thermal print heads 710, 720, while the second memory element or storage area 764 is adapted to store data identified for printing by the other of the first and the second thermal print heads 710, 720.

In a further embodiment, a two-sided direct thermal printer 700 may additionally include a third memory element or storage area 764 in the form of a received print data storage buffer adapted to store data received by the printer 700 for printing by a first and/or a second thermal print head 710, 720 through use of, for example, a communication controller 762. Data from the received print data storage buffer 764 may, then, be retrieved and processed by a processor 766 associated with the printer 700 in order to, for example, split the received print data into a first data portion for printing on a first side of two-sided direct thermal print media 500 by a first thermal print head 710, and a second data portion for printing on a second side of the two-sided direct thermal print media 500 by a second thermal print head 720. Once a split determination has been made, such first and second data portions may, in turn, be stored in respective first and second memory elements or storage areas 764 in preparation for printing by the respective first and second print heads 710, 720.

In still another embodiment, a two-sided direct thermal printer 700 may include one or more predefined memory elements or storage areas 764 for storage of predefined print data comprising, for example, one or more of a coupon or other discount 650, a logo or header 610, a serialized cartoon, a condition of sale, a graphic or other image such as a bar code 660, an advertisement, a security feature, rebate or contest information, ticket information, legal information such as a disclaimer or a warranty, shipping—including origin and destination—information, and the like. Such stored, predefined print data may then be selected for printing on one or both sides of one- or two-sided direct thermal media 400, 500 along with, or separately from, any received print data, such as transaction data from a POS terminal (not shown) associated with the two-sided direct thermal printer 700.

Selection of predefined print data for printing may be provided for though use of, for example, a printing function switch 768 associated with a two-sided direct thermal printer 700. In addition to selecting predefined and/or other received print data for printing on a first and/or a second side 402, 502, 504 of direct thermal media 400, 500, such a switch 768 may enable activation and/or deactivation of one or more printing modes or functions provided for by the printer 700 such as one or more of a single-sided print mode, a double-sided with single-side command mode, a double-sided with double-side command mode, and a double-sided print mode with predefined data, as described in U.S. patent application Ser. No. 11/675,649 entitled "Two-Sided Thermal Print Switch" and filed on Feb. 16, 2007 the contents of which are hereby incorporated by reference herein.

A two-sided printing function switch 768 may be a mechanically operated switch in or on a two-sided direct thermal printer 700, or an electronic or software switch operated by a printer driver executed on an associated host computer, or by firmware or software resident on the printer 700, and the like. The switch 768 may, for example, be electronically operated in response to a command message or escape sequence transmitted to the printer 700. Printer control language or printer job language ("PCL/PJL"), or escape commands, and the like, may be used. A printer setup configuration program setting, e.g., a setting made through a software controlled utility page implemented on an associated host computer, could also electronically operate a switch 768 of a two-sided printer 700.

A two-sided printing function switch 768 of a two-sided printer 700 may be configured, programmed or otherwise setup to select or otherwise identify (1) data for printing (e.g., internally stored predefined data, externally received transaction data, and the like), (2) which of a first and a second print head 710, 720 will be used to print and/or be used to print particular portions of the selected data, (3) whether data selected for printing is to be printed when the media 400, 500 is moving in a first (e.g., forward) or a second (e.g., backward) direction, (4) in which relative and/or absolute media location, including on which media side 402, 502, 504, particular data will be printed, (5) in which orientation (e.g., rightside-up, upside-down, angled, and the like) particular data will be printed on the media 400, 500, (6) where to split selected data for printing by a first and a second print head 710, 720, and the like.

For example, in one embodiment, a setting of a two-sided printing function switch 768 may marshal a first data portion comprising approximately one half of selected print data for printing on a first (e.g., front) side 502 of two-sided direct thermal media 500, and a second data portion comprising approximately the remaining half of the selected print data for printing on a second (e.g., reverse) side 504 of the media 500. As previously described, such selected print data may comprise data received by the printer 700 from a host computer such as a POS terminal (not shown), an ATM (not shown), a self-checkout system (not shown), a personal computer (not shown) and the like, and/or predefined data stored in one or more memory or buffer locations 764 of the printer 700. In this manner a document such as a transaction receipt 600 may be generated in which a first portion of the selected data is printed on a first side 602 of the receipt and a second portion comprising the remaining selected data is printed on a second side 604 of the receipt, conserving upon the amount of media 500 required for printing the selected data.

In further reference to FIG. 7, a two-sided direct thermal printer 700 may also include first and second support arms 714, 716. The first support arm 714 may further be journaled on an arm shaft 718 to permit it to pivot or rotate in relation to the second support arm 716 in order to, for example, facilitate access to, and servicing of, the two-sided direct thermal printer 700, including loading of one- or two-sided direct thermal media 400, 500 therein. In alternate embodiments, the first and second support arms 714, 716 may be in a fixed relation to one another.

As further illustrated in FIG. 7, a first thermal print head 710 and a second platen 740 may be coupled to or formed integrally with a first support arm 714, while a second thermal print head 720 and a first platen 730 may be coupled to or formed integrally with a second support arm 716. In alternate embodiments (not shown), a first thermal print head 710 and a first platen 730 may be coupled to or formed integrally with a first support arm 714 while a second thermal print head 740 and a second platen 720 may be coupled to or formed integrally with a second support arm 716. Additional variations in component design and/or configuration, including a two-sided direct thermal printer 700 designs wherein a first and a second thermal print head 710, 720, and a first platen 730 are coupled to or formed integrally with a second arm 716 while a second platen 740 is coupled to or formed integrally with a first support arm 714, or a first and a second thermal print head 710, 720 and a first and a second platen 730, 740 are coupled to or formed integrally with a first or a second arm 714, 716, and the like, are also possible.

A two-sided direct thermal printer 700 may further include a drive system 712 for transporting media, such as one- or two-sided thermal media 400, 500, through the printer 700 during a print process. A drive system 712 may comprise one or more motors (e.g. stepper, servo, and the like) (not shown) for powering a system of gears, links, cams, belts, wheels, pulleys, rollers, combinations thereof, and the like. In one embodiment, a drive system 712 comprising a stepper motor and one or more gears adapted to rotate one or both of a first and a second platen 730, 740 each provided in the form of a circular cylinder is provided to transport media 400, 500 through the two-sided direct thermal printer 700. In alternate embodiments, a drive system 712 comprising a stepper motor operatively connected to one or more dedicated drive (e.g., non-platen) rollers (not shown) may be provided.

Figure 8:
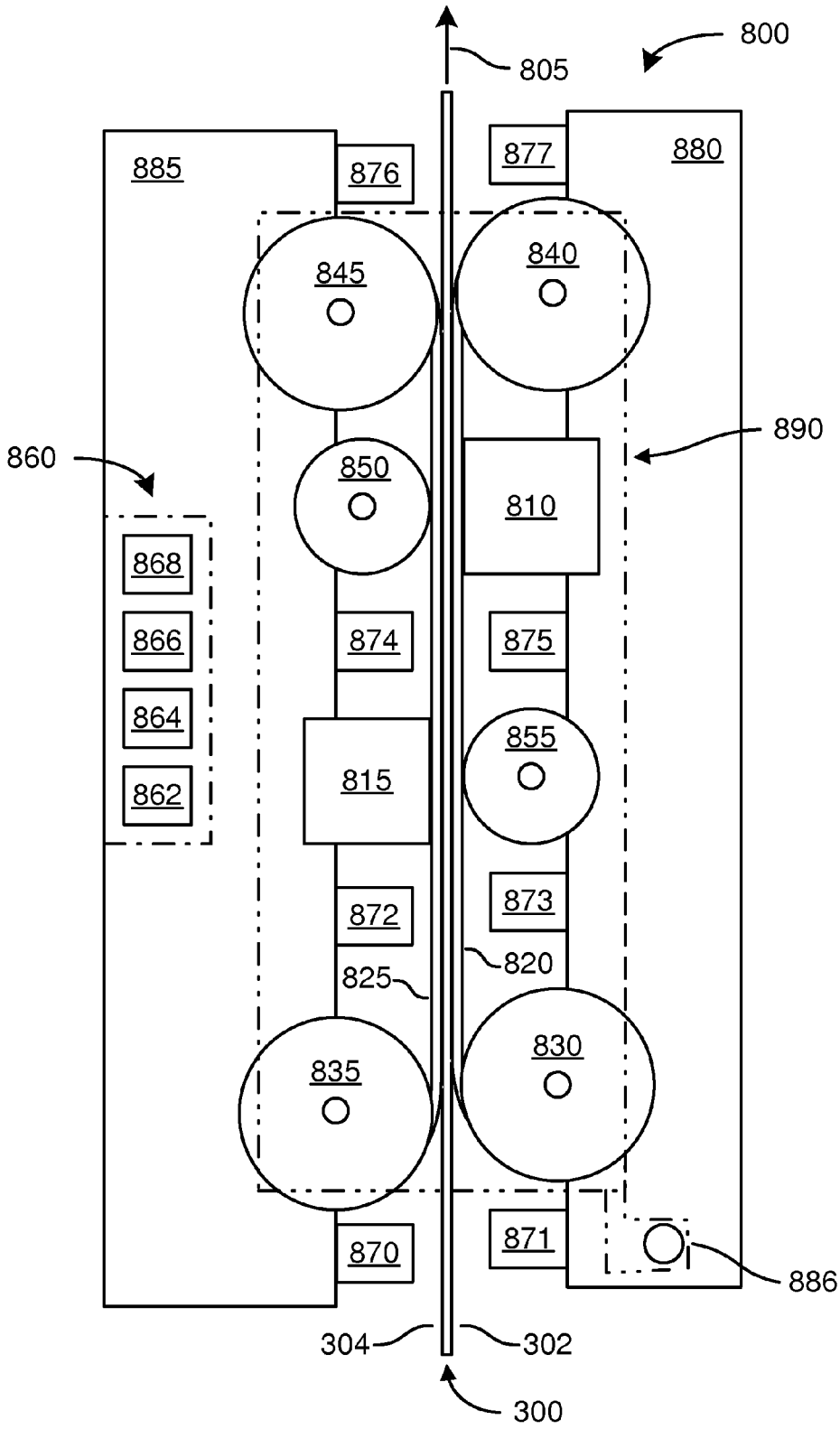
FIG. 8 provides a schematic of a two-sided thermal transfer printer.

FIG. 8 illustrates a two-sided thermal transfer printer 800 for thermal transfer printing of one or both sides of media such as the one- or two-sided thermal transfer media 200, 300 of FIGS. 2 and 3. As shown in FIG. 8, a two-sided thermal transfer printer 800 may comprise first and second thermal print heads 810, 815 for printing on respective first and/or second sides 202, 204, 302, 304 of one- or two-sided media 200, 300 moving along a media feed path 805. Additionally, first and second platens 850, 855 may be provided on opposite sides of the media 200, 300 and feed path 805 thereof proximate to the first and second print heads 810, 815 in order to, for example, maintain contact between the first and second print heads 810, 815 and a respective first and second side 202, 204, 304, 302 of the media 200, 300.

Depending on the printer design and/or application, print media such as the one- or two-sided thermal transfer media 200, 300 of FIGS. 2 and 3 may be supplied in the form of a roll, fan-fold stock, individual (cut) sheets, and the like, upon which information in text and/or graphic form may be printed on one or both sides 202, 204, 302, 304 thereof to provide, for example, a voucher, coupon, receipt, ticket, label, or other article or document. It should be noted that, unlike with direct thermal printing, it may be possible to print on a side 202 of media 200 absent inclusion of any specific thermal transfer receptive coating 220, 320, 330 using a two-sided thermal transfer printer 800, however print quality and/or longevity, and the like, may be affected.

As shown in FIG. 8, a two-sided thermal transfer printer 800 may additionally comprise first and second thermal transfer ribbons 820, 825 for providing functional thermal transfer coatings 120 for thermal transfer printing on respective first and second sides 202, 204, 302, 304 of one- or two-sided thermal transfer media 200, 300. Such first and second ribbons 820, 825 may be supported on first and second supply 830, 835 and take-up/rewind 840, 845 reels or supports within the printer 800, which reels or supports may additionally maintain a desired or required tension on the respective ribbons 820, 825 during a print process.

In further reference to FIG. 8, a two-sided thermal transfer printer 800 may also include first and second support arms 880, 885. The first support arm 880 may further be journaled on an arm shaft 886 to permit it to pivot or rotate in relation to the second support arm 885 in order to, for example, facilitate access to, and servicing of, the two-sided thermal transfer printer 800, including loading of one- or two-sided thermal transfer media 200, 300, and/or thermal transfer ribbons 100 therein. In alternate embodiments, the first and second support arms 880, 885 may be in a fixed relation to one another.

As further illustrated in FIG. 8, a first thermal print head 810, a second platen 855, and a first supply and take-up reel or support 830, 840 may be coupled to or formed integrally with a first support arm 880, while a second thermal print head 815, a first platen 850, and a second supply and take-up reel or support 830, 840 may be coupled to or formed integrally with a second support arm 885. Variations are also possible.

A two-sided thermal transfer printer 800 may further include a drive system 890 for transporting media, such as one- or two-sided thermal transfer media 200, 300, and/or first and second thermal transfer ribbons 820, 825 through the printer 800 and/or across one or both of the thermal print heads 810, 815 during a print process. Depending on the design and/or application, a drive system 890 may comprise one or more motors (e.g. stepper, servo, and the like) (not shown) for powering a system of gears, links, cams, belts, wheels, pulleys, rollers, combinations thereof, and the like. In one embodiment, a drive system 890 comprising a stepper motor and one or more gears adapted to rotate one or both of a first and a second platen 850, 855 each provided in the form of a circular cylinder is provided to transport media 200, 300 through the two-sided thermal transfer printer 800. In alternate embodiments, a drive system 890 comprising a stepper motor operatively connected to one or more dedicated drive (e.g., non-platen) rollers (not shown), and/or one or both of the ribbon 820, 825 supply 830, 835 and/or take-up 840, 845 rollers may be provided.

As shown in FIG. 8, a two-sided thermal transfer printer 800 may further include a controller 860 for controlling operation of the printer 800. Like the controller 760 of the two-sided direct thermal printer 700 of FIG. 7, the controller 860 of a two-sided thermal transfer printer such as the two-sided thermal transfer printer 800 of FIG. 8 may comprise a communication controller 862, one or more buffers or memory elements 864, a processor 866, and/or a printing function switch 868, each of which may perform one or more functions and/or operations consistent with the counterpart components 762, 764, 766, 768 of the two-sided direct thermal printer 700 of FIG. 7 described hereinabove.

Figure 9:
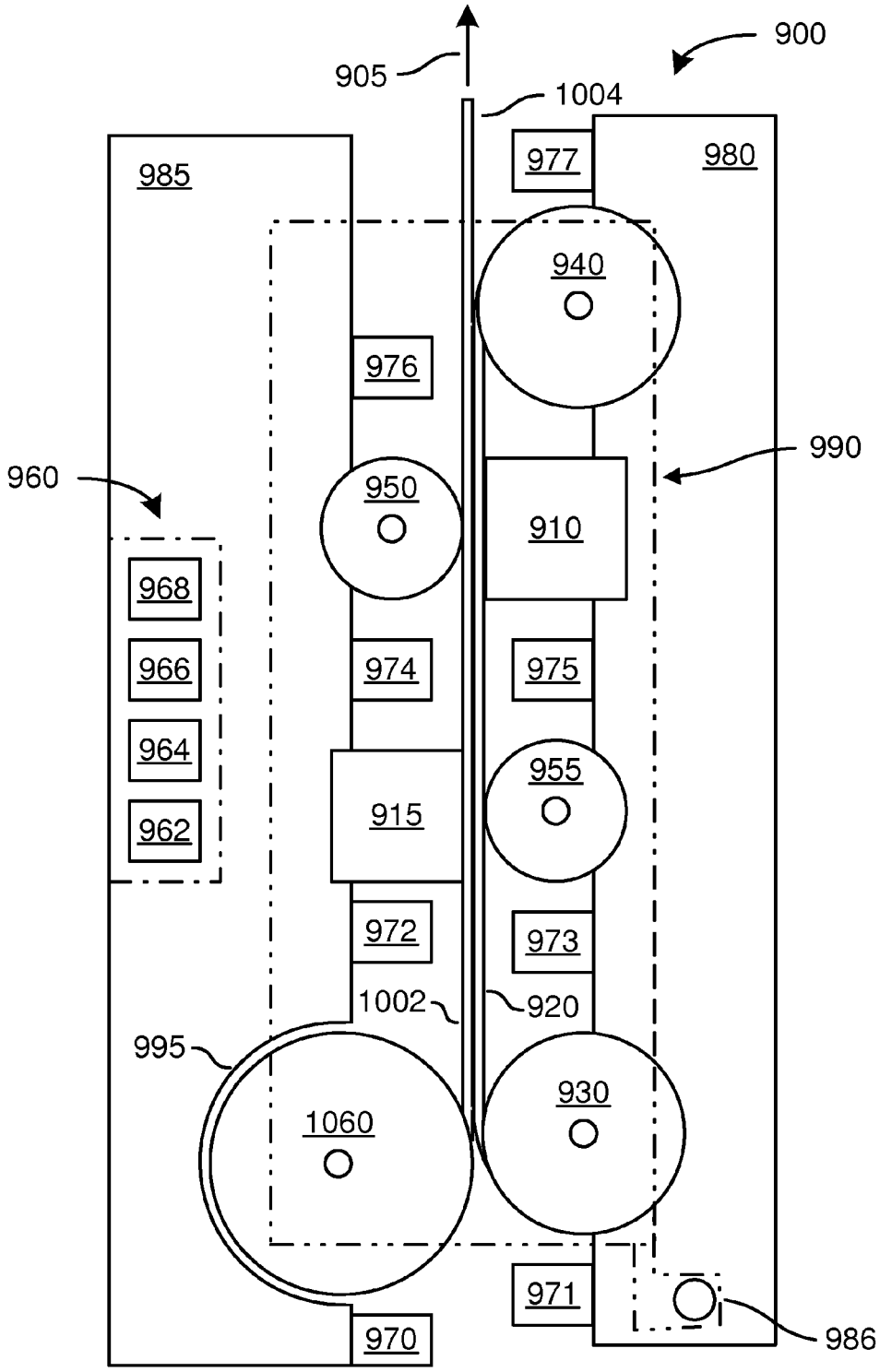
FIG. 9 provides a schematic of a combined two-sided direct thermal and thermal transfer printer.
Figure 10:
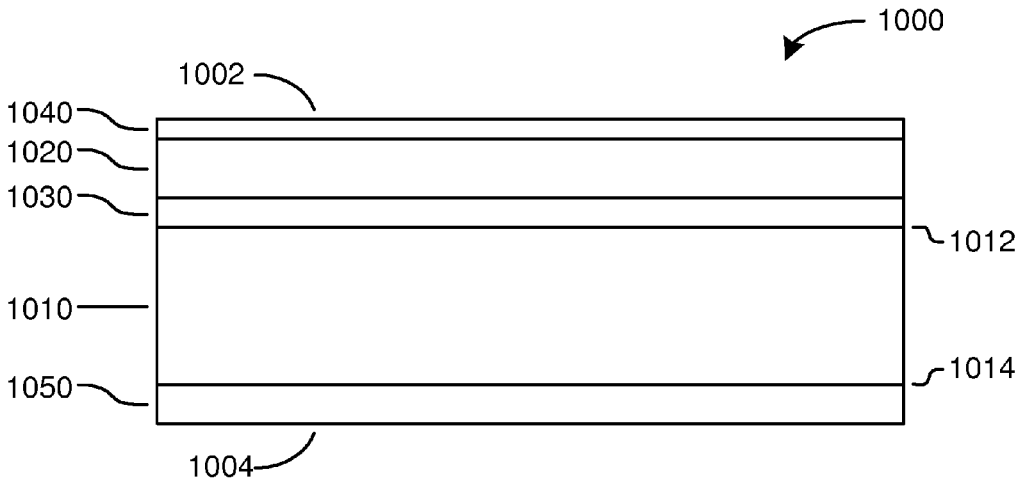
FIG. 10 provides a cross-sectional view of combined two-sided direct thermal and thermal transfer media for use as, inter alia, a transaction receipt, ticket, label, or other document.

FIG. 9 illustrates a combined two-sided direct thermal and thermal transfer printer 900 for combined direct thermal and thermal transfer printing of, inter alia, combined direct thermal and thermal transfer media 1000 as illustrated in FIG. 10. As shown in FIG. 9, a combined two-sided direct thermal and thermal transfer printer 900 may comprise first and second thermal print heads 910, 915 for printing on respective first and/or second sides 1002, 1004 of combined two-sided direct thermal and thermal transfer media 1000 moving along a media feed path 905. Additionally, first and second platens 950, 955 may be provided on opposite sides of the media 1000 and feed path 905 thereof proximate to the first and second print heads 910, 915 in order to, for example, maintain contact between the first and second print heads 910, 915 and a respective first and second side 1002, 1004 of the media 1000.

As shown in FIG. 10, combined two-sided direct thermal and thermal transfer media 1000 may comprise a substrate 1010 having a direct thermally sensitive coating 1020 on a first side 1012 thereof, and a thermal transfer receptive coating 1050 on a second side 1014 thereof. As for the one- or two-sided thermal transfer and/or direct thermal media 200, 300, 400, 500 illustrated in FIGS. 2, 3, 4, and 5, the substrate 1010 of combined two-sided direct thermal and thermal transfer media may comprise a fibrous or film type sheet either or both of which may comprise one or more natural (e.g., cellulose, cotton, starch, and the like) and/or synthetic (e.g., polyethylene, polyester, polypropylene, and the like) materials. In one embodiment, a substrate 1010 is provided in the form of a starch based paper.

Likewise, a direct thermally sensitive coating 1020 and a thermal transfer receptive coating 1050 of a combined two-sided direct thermal and thermal transfer media 1000 may comprise any of the respective coatings 220, 320, 330, 420, 520, 550 discussed with regard to the one- or two-sided thermal transfer and/or direct thermal media 200, 300, 400, 500 illustrated in FIGS. 2, 3, 4, and 5 such as a direct thermally sensitive coating 1020 comprising a leuco-dye, developer and sensitizer, and a thermal transfer receptive coating 1050 comprising 90% clay and 10% PVA (as-dried).

As further illustrated in FIG. 10, combined two-sided direct thermal and thermal transfer media 1000 may further comprise a sub coat 1030, and a top coat 1040. Where provided, a sub coat 1030 may be included as a buffer region between a first surface 1012 of a substrate 1010 and a direct thermally sensitive coating 1020 to avoid adverse interaction of chemicals and/or impurities in the substrate 1010 with the direct thermally sensitive coating 1020, and thereby avoid undesired and/or premature imaging. Further, a sub coat 1030 may be provided to prepare an associated surface 1012 of a substrate 1010 for reception of a thermally sensitive coating 1020, such as by providing for a desired or required surface finish or smoothness. Suitable sub coats 1030 include clay and/or calcium carbonate based coatings as described with regard to FIGS. 4 and 5.

A top coat 1040 may be provided over a direct thermally sensitive coating 1020 to protect the thermally sensitive coating and/or any resultant image from mechanical (e.g., scratch, smudge, smear, and the like) and/or environmental (chemical, UV, and the like) degradation. Likewise, a top coat 1040 may be provided to enhance slip between the thermally sensitive coated side 1002 of the combined two-sided direct thermal and thermal transfer media 1000 and various components of a thermal printer such as, but not limited to a thermal print head. A top coat 1040 may include any suitable components that serve to protect or enhance the performance and/or properties of a thermally sensitive layer 1020 such as one or more polymers, monomers, UV absorbers, scratch inhibitors, smear inhibitors, slip agents, and the like, as also described with regard to FIGS. 4 and 5.

Depending on the printer design and/or application, print media such as the combined two-sided direct thermal and thermal transfer media 1000 of FIG. 10 may be supplied in the form of a roll 1060, fan-fold stock, individual (cut) sheets, and the like, upon which information in text and/or graphic form may be printed on one or both sides 1002, 1004 thereof to provide, for example, a voucher, coupon, receipt, ticket, label, or other article or document. It should be noted that it may be possible to direct thermally print on a first, direct thermally coated side 402, 502, 504 and thermally transfer print on a second, direct thermally coated or un-coated side 404, 504, 502 of one- or two-sided direct thermal media 400, 500 rather than on respective direct thermal and thermal transfer coated sides 1002, 1004 of combined direct thermal and thermal transfer media 1000, however thermal transfer print quality and/or longevity, and the like, may be affected.

As shown in FIG. 9, a combined two-sided direct thermal and thermal transfer printer 900 may additionally comprise a thermal transfer ribbon 920 for providing a functional, thermal transfer coating 120 for thermal transfer printing on a thermal transfer receptive side 1004 or a direct thermal coated side 1002 of combined, two-sided direct thermal and thermal transfer media 1000, or a side 202, 204, 302, 304, 404, 404, 502, 504 of one- or two-sided direct thermal or thermal transfer media 200, 300, 400, 500. Such ribbon 920 may be supported on supply 930 and take-up/rewind 940 reels or supports within the printer 900, which reels or supports may additionally maintain a desired or required tension of the ribbon 920 during a printer operation.

In further reference to FIG. 9, a combined two-sided direct thermal and thermal transfer printer 900 may also include first and second support arms 980, 985. The first support arm 980 may further be journaled on an arm shaft 986 to permit it to pivot or rotate in relation to the second support arm 985 in order to, for example, facilitate access to, and servicing of, the two-sided thermal transfer printer 900, including loading of media 1000, including a roll 1060 thereof, and/or a transfer ribbon 920 therein. In alternate embodiments, the first and second support arms 980, 985 may be in a fixed relation to one another.

As further illustrated in FIG. 9, a first thermal print head 910, a second platen 955, and first supply and take-up reels or supports 930, 940 may be coupled to or formed integrally with a first support arm 980, while a second thermal print head 915, a first platen 950, and a recess and/or support 995 for media 1000 or a roll 1060 thereof, may be coupled to or formed integrally with a second support arm 985. Variations are possible.

A combined two-sided direct thermal and thermal transfer printer 900 may further include a drive system 990 for transporting media, such as combined two-sided direct thermal and thermal transfer media 1000, and/or a thermal transfer ribbon 920 through the printer 900 during a print process. Depending on the design and/or application, a drive system 990 may comprise one or more motors (e.g. stepper, servo, and the like) (not shown) for powering a system of gears, links, cams, belts, wheels, pulleys, rollers, combinations thereof, and the like. In one embodiment, a drive system 990 comprising a series of individual stepper motors coupled to each of the respective first and second platens 950, 955 and supply and take-up/rewind reels 930, 940 is provided to transport media 1000 and/or thermal transfer ribbon 920 through the combined two-sided direct thermal and thermal transfer printer 900. Use of individual stepper motors provides for independent control over rotation of a given platen 950, 955 and/or supply and take-up reel 930, 940, allowing for, inter alia, control of tension of the media 1000 and/or thermal transfer ribbon 920. Such a drive system 990 would also allow for forward (e.g., pursuant to the arrow representing the media feed path 905) and/or backward (e.g., counter to the arrow representing the media feed path 905) feed of media 1000 and/or thermal transfer ribbon 920, thereby allowing for dual-direction and/or repetitive printing, and allowing for rewind and/or re-use of the thermal transfer ribbon 920. In alternate embodiments, a drive system 990 comprising a single stepper motor operatively connected the first and/or second platens 950, 955 and/or supply and/or take-up reels 930, 940, and/or one or more dedicated drive (e.g., non-platen) rollers (not shown), may be provided.

As shown in FIG. 9, a combined two-sided direct thermal and thermal transfer printer 900 may further include a controller 960 for controlling operation of the printer 900. Like the controller 760 of the two-sided direct thermal printer 700 of FIG. 7, and the controller 860 of the two-sided thermal transfer printer 800 of FIG. 8, the controller 960 of a combined two-sided direct thermal and thermal transfer printer such as the combined two-sided direct thermal and thermal transfer printer 900 of FIG. 9 may comprise a communication controller 962, one or more buffers or memory elements 964, a processor 966, and/or a printing function switch 968, each of which may perform one or more functions and/or operations consistent with the counterpart components 762, 764, 766, 768 of the two-sided direct thermal printer 700 of FIG. 7 described hereinabove.

Figure 11:
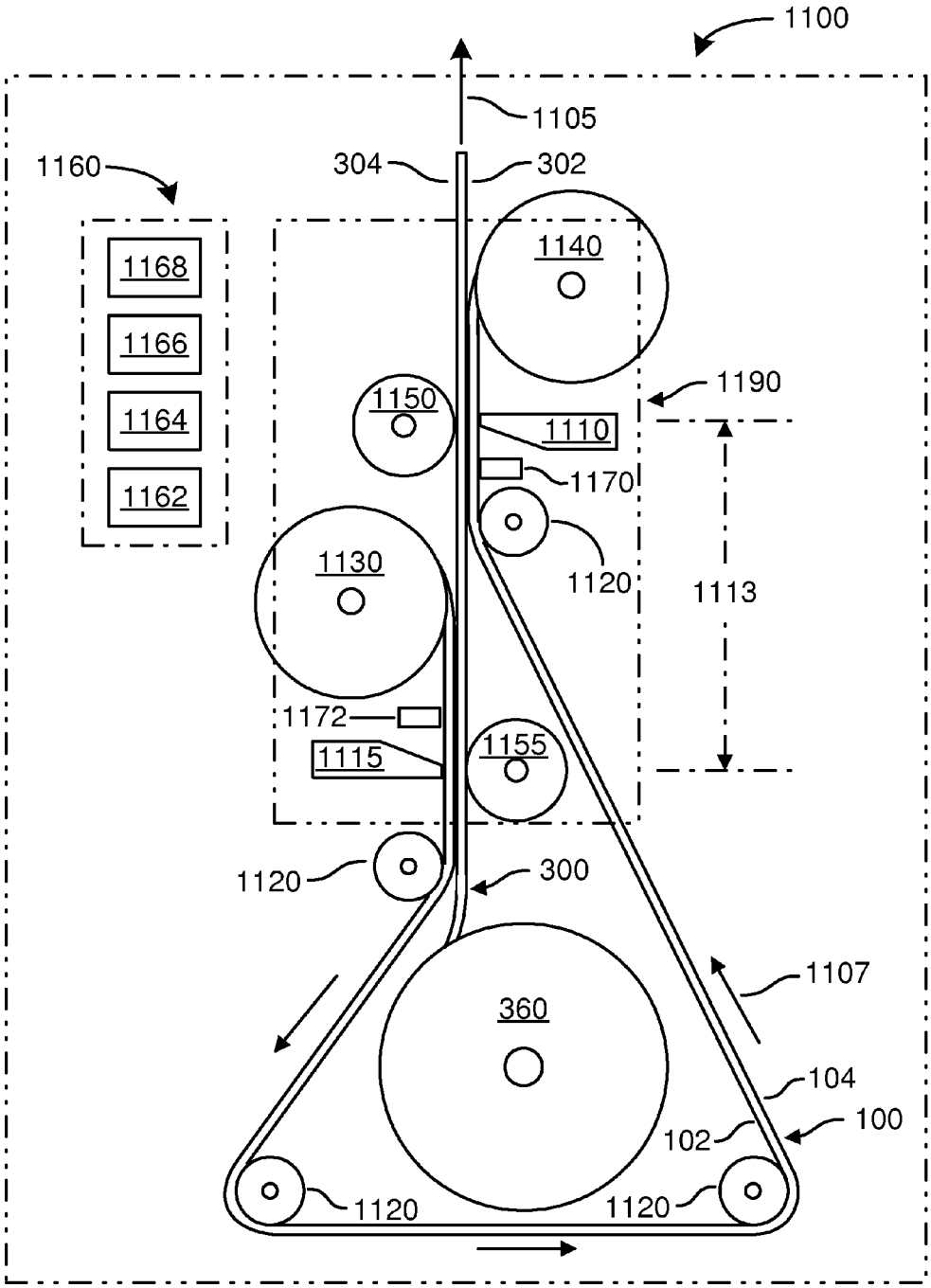
FIG. 11 provides a second schematic of a two-sided thermal transfer printer.

FIG. 11 illustrates a two-sided thermal transfer printer 1100 for thermal transfer printing of one- or two-sides of media such as any of the media 200, 300, 400, 500, 1000 of FIGS. 2, 3, 4, 5 and 10. As shown in FIG. 11, a two-sided thermal transfer printer 1100 may comprise first and second thermal print heads 1110, 1115 for printing on, for example, respective first and/or second sides 302, 304 of two-sided thermal transfer media 300 moving along a media feed path 1105.

As shown in FIG. 11, a two-sided thermal transfer printer 1100 may additionally comprise a single thermal transfer ribbon 100 comprising a single, functional thermal transfer coating 120 for thermal transfer printing of respective one- or two-sides of print media such as a first and a second side 302, 304 of two-sided thermal transfer media 300. Such ribbon 100 may be supported on supply 1130 and take-up/rewind 1140 reels or supports within the printer 1100, which reels or supports may additionally maintain a desired or required tension on the ribbon 100 during printer 1100 operation.

Additionally, a two-sided thermal transfer printer 1100 may include first and second platens 1150, 1155 on opposite sides 304, 302 of the media 300 and feed path 1105 thereof proximate to first and second print heads 1110, 1115 in order to, for example, maintain contact between the print heads 1110, 1115, print media 300, and thermal transfer ribbon 100.

Depending on the printer design and/or application, print media such as the one- or two-sided thermal transfer media 300 of FIG. 3 may be supplied in the form of a roll 360, fan-fold stock, individual (cut) sheets, and the like, upon which information in text and/or graphic form may be simultaneously or near simultaneously printed on one or both sides 302, 304 thereof to provide, for example, a one- or two-sided voucher, coupon, receipt, ticket, label, or other article or document. As previously noted, it may be possible to print on a side of media without a specific thermal transfer receptive coating, such as the back side 202 of the media 200 of FIG. 2, using a two-sided thermal transfer printer 1100, however print quality and/or longevity, and the like, may be affected.

A two-sided thermal transfer printer 1100 may further include one or more rollers 1120 for, inter alia, guiding thermal transfer media 300 and/or thermal transfer ribbon 100 along the respective media 1105 and ribbon 1107 feed paths through the printer 1100. Further, some or all of such rollers may additionally or alternatively provide means for transporting the ribbon 100 and/or media 300 through the printer 100, and/or maintain a desired tension of the ribbon 100 and/or media 300, alone or in combination with one or more of platens 1150, 1155, drive systems 1190, and the like.

As shown in FIG. 11, such rollers 1120 may also provide means for orienting a functional coated surface 102 of a thermal transfer ribbon 100 toward a printing surface 302, 304 of thermal transfer print media 300 for printing on both sides 302, 304 of such media 300 using a single thermal transfer ribbon 100.

As shown in FIG. 11, a two-sided thermal transfer printer 1100 may also include a drive system 1190 for transporting media, such as two-sided thermal transfer media 300, and/or thermal transfer ribbon 100 through the printer 1100 during a print process. Depending on the design and/or application, a drive system 1190 may comprise one or more motors (e.g. stepper, servo, and the like) (not shown) for powering a system of gears, links, cams, belts, wheels, pulleys, rollers, combinations thereof, and the like. In one embodiment, a drive system 890 comprising a stepper motor (not shown) and one or more gears (not shown) adapted to rotate one or both of a first and a second platen 1150, 1155 each provided in the form of a circular cylinder is provided to transport media 300 and ribbon 100 through the two-sided thermal transfer printer 1100. In alternate embodiments, a drive system 1190 comprising a stepper motor (not shown) operatively connected to one or more dedicated drive (e.g., non-platen) rollers (not shown), and/or one or both of the ribbon 100 supply 1130 and/or take-up 1140 rollers or supports may be provided.

A drive system 1190 may also provide means for lifting (e.g., moving substantially normal from a respective ribbon 100 and/or media 300 surface 102, 104, 302, 304) and/or laterally traversing (e.g., moving toward a side edge of a ribbon 100 or media 300 transverse to a media feed path 1105 or ribbon feed path 1107 direction) one or both print heads 1110, 1115 off of or away from the ribbon 100 and/or media 300. Such system 1190 may be required or desired in order to, for example, lift a print head 1110, 1115 off of a thermal transfer ribbon 100 and/or media 300 prior to advancing and/or rewinding a thermal transfer ribbon 100 and/or media 300 where such advance and/or rewind would otherwise result in the ribbon 100 and/or media 300 moving relative to each other (e.g., counter to one another and/or at different respective speeds in the same direction, and the like). In one embodiment, a drive system 1190 is adapted to lift a second print head 1115 off of a thermal transfer ribbon 100 prior to advancing the ribbon 100 and media 300 for further printing where a ribbon feed path 1107 direction is counter to a media feed path 1105 direction, as shown with regard to the second thermal print head 1115 of FIG. 11.

Suitable means for lifting and/or laterally traversing one or both print heads 1110, 1115 of a two-sided thermal printer such as the two-sided thermal transfer printer 1100 of FIG. 11 may include one or more motors, solenoids, screw-drives, linear-actuators, ratchets, springs, hydraulic and/or pneumatic cylinders, and the like.

It should be noted that lifting and/or laterally traversing of one or both print heads 1110, 1115 of a two-sided thermal printer such as the two-sided thermal transfer printer 1100 of FIG. 11 may also be employed to take a respective print head 1110, 1115 out-of-service in situations where, for example, such printer is used for single sided thermal printing or the respective print head 1110, 1115 is otherwise manually or automatically disabled from use as further discussed herein below.

In some embodiments, a two-sided thermal transfer printer 1100 may also include first and second support arms (not shown) for supporting some or all of the first and second print heads 1110, 1115, first and second platens 1150, 1155, and thermal transfer ribbon 100 supply 1130 and/or take-up rollers or supports 1140, which support arms may further be in fixed or pivotable relation to one another as illustrated in, and discussed in regard to, FIGS. 7, 8 and 9.

Likewise, a two-sided thermal transfer printer 1100 may further include a controller 1160 for controlling operation of the printer 1100. As described with regard to the two-sided direct thermal printer 700 of FIG. 7, the controller may comprising, inter alai, a communication controller 1162, one or more buffers or memory elements 1164, a processor 1166, and/or a printing function switch 1168, each of which may perform one or more functions and/or operations consistent with the counterpart components described with regard to FIG. 7 hereinabove.

Figure 12:
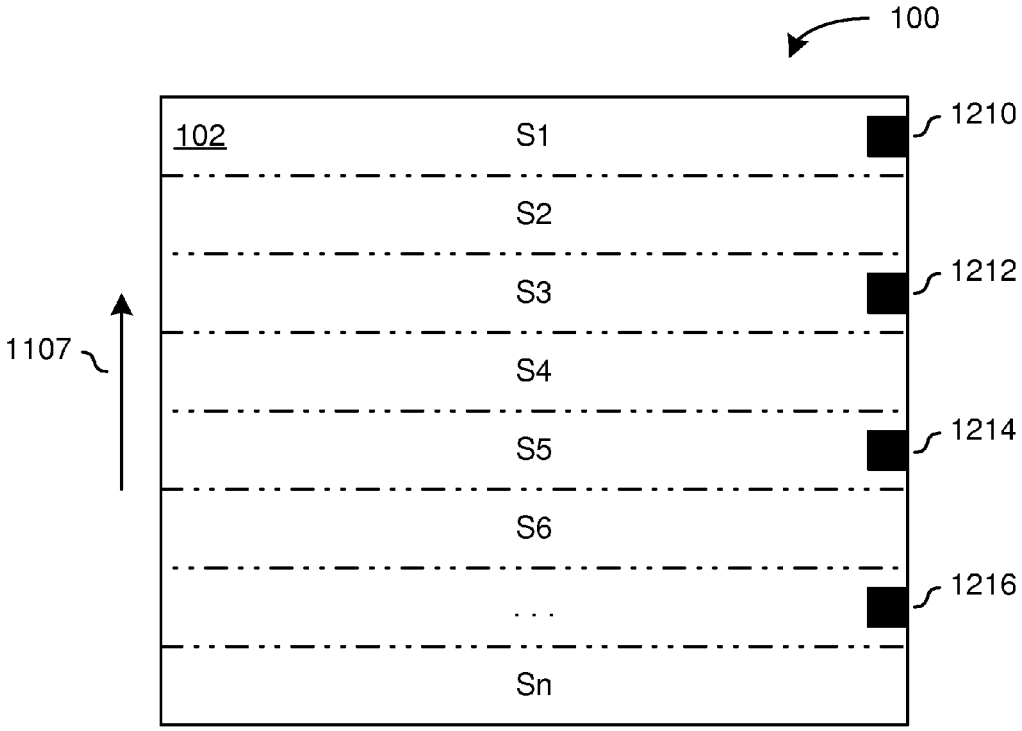
FIG. 12 provides a plan view of a thermal transfer coated side of a thermal transfer ribbon.

In addition, in one embodiment, a controller 1160 of a two-sided thermal transfer printer 1100 may be used to virtually segment a functional coat 120 of a thermal transfer ribbon 100 into uniform bands for printing on opposite sides of media such as a first and a second side 302, 304 of two-sided thermal transfer media 300. For example, as shown in FIG. 12, a functional coating 120 on a first side 102 of a thermal transfer ribbon 100 may be virtually segmented by a processor 1166 associated with a two-sided thermal transfer printer 1100 into odd and even numbered segments, S1, S2, S3, S4, S5, S6, and the like, such that printing on a first side 302 of media 300 occurs through use of odd numbered bands S1, S3, S5 of the functional coating 120, and printing of a second side 304 of media 300 occurs through use of even numbered bands S2, S4, S6 of the functional coating 120. Registration of the thermal transfer ribbon 100 with regard to the first and the second thermal print heads 1110, 1115 for printing with respective odd and even numbered bands may be provided through control over the lateral spacing 1113 of the print heads 1110, 1115, the length of ribbon 100 along the ribbon feed path 1107 between the print heads 1110, 1115, and/or the relative movement and/or displacement of the ribbon 100 with respect to the media 300 through use of a drive system 1190, among other means. Likewise, as further illustrated in FIG. 12, one or more sense marks 1210, 1212, 1214, 1216, may be provided on the ribbon 100 and/or media 300 (not shown) for control of relative or absolute ribbon 100 and/or media 300 location in concert with one or more sensors 1170, 1172 associated with a two-sided thermal transfer printer 1100. It should be noted the one or more sense marks 1210, 1212, 1214, 1216 may be provided on a first side 102 (as shown) and/or a second side 104 (not shown) of a thermal transfer ribbon 100, and/or utilized media 300 (not shown).

Figure 13:
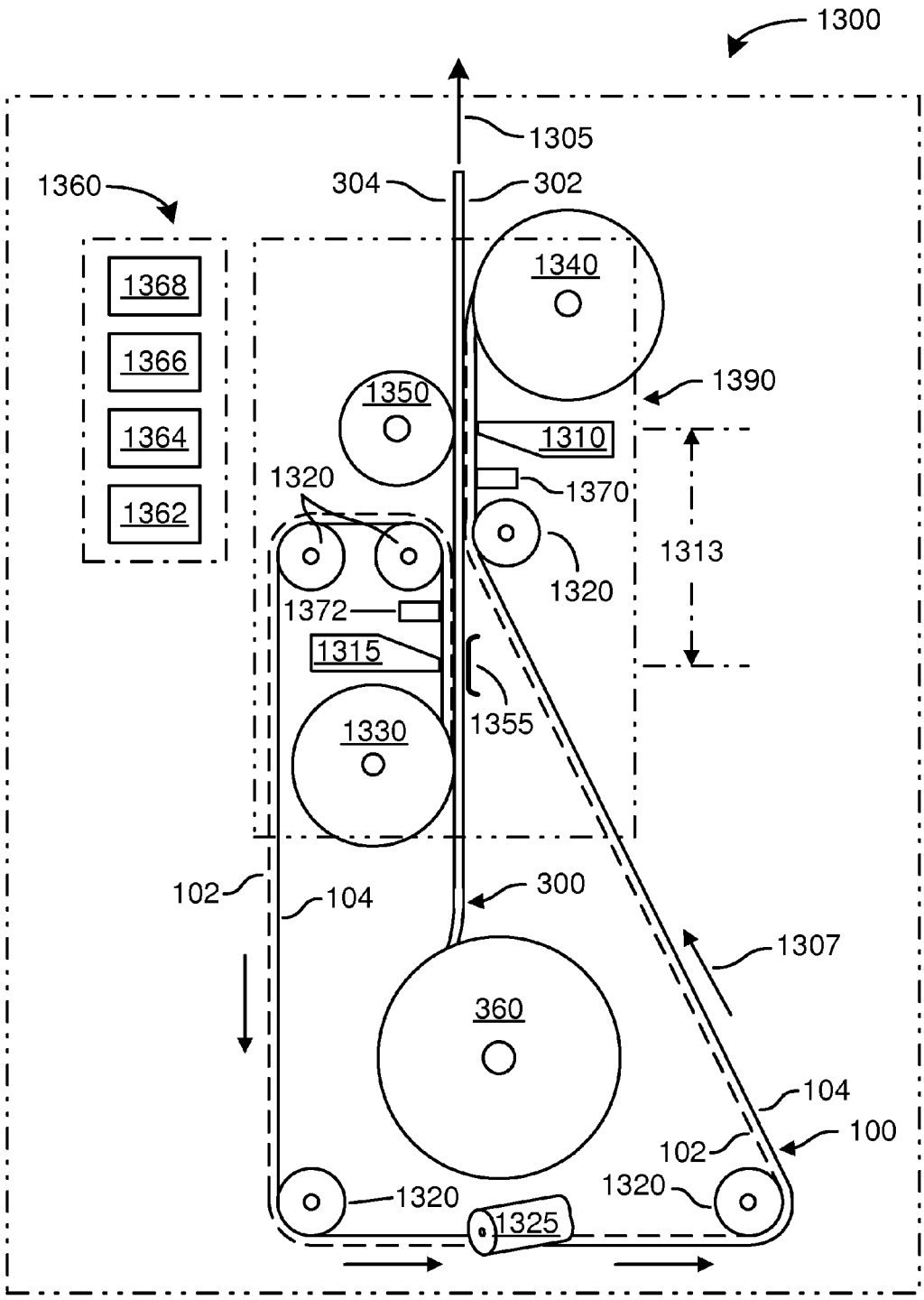
FIG. 13 provides a third schematic of a two-sided thermal transfer printer.

FIG. 13 illustrates a two-sided thermal transfer printer 1300 for thermal transfer printing of one- or two-sides of media such as any of the media 200, 300, 400, 500, 1000 of FIGS. 2, 3, 4, 5 and 10. As shown in FIG. 13, a two-sided thermal transfer printer 1300 may comprise first and second thermal print heads 1310, 1315 for printing on, for example, respective first and/or second sides 302, 304 of two-sided thermal transfer media 300 moving along a media feed path 1305.

As shown in FIG. 13, a two-sided thermal transfer printer 1300 may additionally comprise a single thermal transfer ribbon 100 comprising a functional thermal transfer coating 120 on a first side 102 thereof for thermal transfer printing of respective one- or two-sides of print media such as a first and a second media side 302, 304 of two-sided thermal transfer media 300. Such ribbon 100 may be supported on supply 1330 and take-up/rewind 1340 reels or supports within the printer 1300, which reels or supports may additionally maintain a desired or required tension on the ribbon 100 during printer 1300 operation.

Additionally, a two-sided thermal transfer printer 1300 may include first and second platens 1350, 1355 on opposite sides 304, 302 of the media 300 and feed path 1305 thereof proximate to first and second print heads 1310, 1315 in order to, for example, maintain contact between the print heads 1310, 1315, print media 300, and thermal transfer ribbon 100 during printer 1300 operation. As shown in FIG. 13, the first platen 1350 comprises a roller-type (e.g., cylindrical) platen while the second platen 1355 comprises a plate-type platen. As shown in FIG. 13, the plate-type platen 1355 may further include tapered leading and/or trailing edges to mitigate against damage to the media 300 and thermal transfer ribbon 100 as they traverse the platen.

Depending on the printer design and/or application, print media such as the two-sided thermal transfer media 300 of FIG. 3 may be supplied in the form of a roll 360, fan-fold stock, individual (cut) sheets, and the like, upon which information in text and/or graphic form may be printed on one or both sides 302, 304 thereof to provide, for example, a voucher, coupon, receipt, ticket, label, or other article or document.

A two-sided thermal transfer printer 1300 may further include one or more rollers or other guides 1320 for, inter alia, guiding thermal transfer media 300 and/or thermal transfer ribbon 100 along respective media and ribbon feed paths 1305, 1307 through the printer 1300. Additionally or alternatively, some or all of such rollers 1320 may provide means for transporting the ribbon 100 and/or media 300 through the printer 1300, and/or maintaining a desired tension of the ribbon 100 and/or media 300, alone or in combination with one or more supply 1330 and take-up/rewind 1340 reels or supports, platens 1350, 1355, drive systems 1390, and the like.

A drive system 1390 associated with a two-sided thermal transfer printer 1300 may provide for transportation of print media, such as the two-sided thermal transfer media 300 of FIG. 3, and/or thermal transfer ribbon, such as the thermal transfer ribbon 100 of FIG. 1, through the printer 1300 during printer operation. Depending on the design and/or application, a drive system 1390 may comprise one or more motors (e.g. stepper, servo, and the like) (not shown) for powering a system of gears, links, cams, belts, wheels, pulleys, rollers, combinations thereof, and the like, in operative contact with the media 300 and/or thermal transfer ribbon 100. In one embodiment, a drive system 1390 comprising a stepper motor (not shown) and one or more gears (not shown) adapted to rotate a first platen 1350 and one or more rollers 1320 each provided in the form of a circular cylinder is provided to transport media 300 and ribbon 100 through the two-sided thermal transfer printer 1300. In alternate embodiments, a drive system 1390 comprising a stepper motor (not shown)

operatively connected to one or more dedicated drive (e.g., non-platen) rollers, such as any of the guide rollers 1320, and/or one or both of the ribbon 100 supply 1330 and/or take-up 1340 rollers or supports may be provided.

In alternate embodiments, a two-sided thermal transfer printer 1300 may also include first and second support arms (not shown) for supporting some or all of the first and second print heads 1310, 1315, first and second platens 1350, 1355, thermal transfer ribbon 100 supply 1330 and/or take-up rollers or supports 1340, any or all of the rollers 1320 used for, inter alia, guiding, feeding, and/tensioning the media 300 and/or thermal transfer ribbon 100, one or more turn bars 1325, and the like. Additionally, as illustrated in, and discussed in regard to, FIGS. 7, 8 and 9, where provided, the support arms may further be in fixed or pivotable relation to one another.

As additionally shown in FIG. 13, a two-sided thermal transfer printer 1300 may further include a controller 1360 for controlling operation of the printer 1300. As described with regard to the two-sided direct thermal printer 700 of FIG. 7, and the two-sided thermal transfer printer 1100 of FIG. 11, the controller 1360 may comprising, inter alai, a communication controller 1362, one or more buffers or memory elements 1364, a processor 1366, and/or a printing function switch 1368, each of which may perform one or more functions and/or operations consistent with the counterpart components described with regard to FIGS. 7 and 11 hereinabove, including providing for printing with alternating portions of a virtually or otherwise segmented thermal transfer ribbon 100 by a first and a second thermal print head 1310, 1315 of a two-sided thermal transfer printer 1300, which segmented printing may further employ one or more sensors 1370, 1372 associated with the printer 1300 for maintaining registration of the ribbon 100 with the media 300.

As shown in FIG. 13, a two-sided thermal transfer printer 1300 may further comprise one or more turn bars 1325 for turning a thermal transfer ribbon 100 such that a first side 102 thereof comprising a thermal transfer (functional) coating 120 appropriately faces first and second sides 302, 304 of print media 300 thereby allowing for thermal transfer printing by a respective first and a second thermal print head 1310, 1315 thereon. Such configuration permits use of one thermal transfer ribbon 100 for printing on both sides 302, 304 of print media 300, while providing for co-directional motion of the media 300 and ribbon 100, thereby reducing or eliminating slip and related issues such as, but not limited to, smudging and smearing of the functional coating 120 of the ribbon 100 on the media 300.

Figure 14:
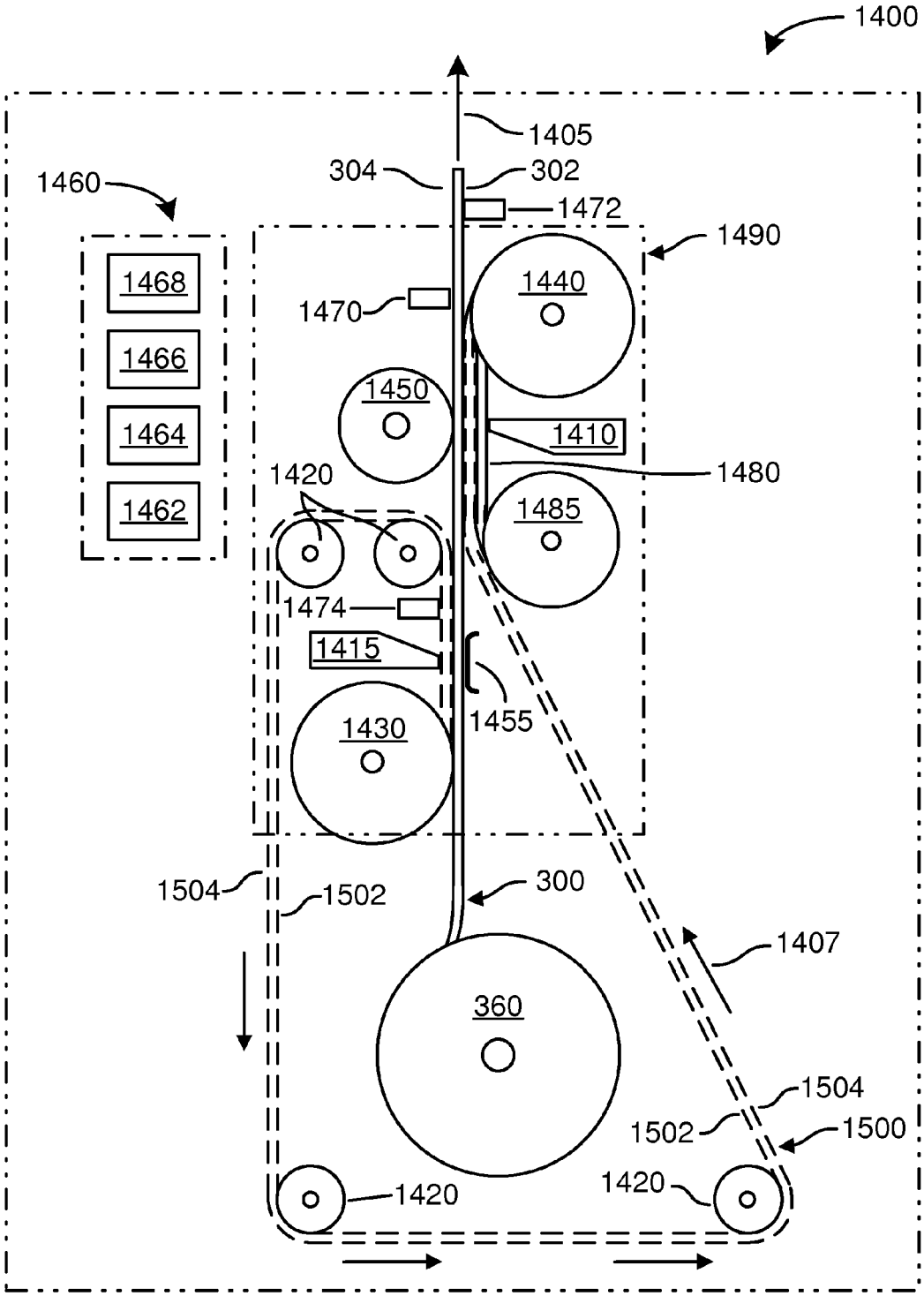
FIG. 14 provides a fourth schematic of a two-sided thermal transfer printer.

FIG. 14 illustrates a two-sided thermal transfer printer 1400 for thermal transfer printing of one- or two-sides of media such as any of the media 200, 300, 400, 500, 1000 of FIGS. 2, 3, 4, 5 and 10. As shown in FIG. 14, a two-sided thermal transfer printer 1400 may comprise first and second thermal print heads 1410, 1415 for printing on, for example, respective first and/or second sides 302, 304 of two-sided thermal transfer media 300 moving along a media feed path 1405.

Figure 15:
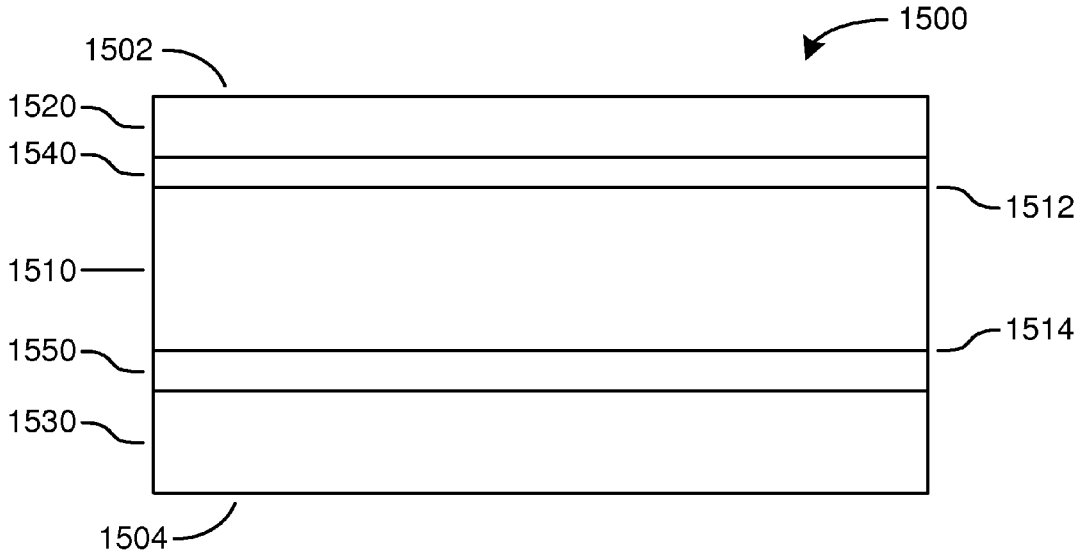
FIG. 15 provides a cross-sectional view of two-sided thermal transfer ribbon for, inter alia, thermal transfer printing of media such as transaction receipts, tickets, labels, and other documents.

As shown in FIG. 14, a two-sided thermal transfer printer 1400 may additionally comprise a two-sided thermal transfer ribbon 1500. As shown in FIG. 15, a two-sided thermal transfer ribbon 1500 may comprise a substrate 1510 with a first functional or thermal transfer coating 1520 on a first side 1512 thereof, and a second functional or thermal transfer coating 1530 on a second side 1514 thereof.

A two-sided thermal transfer ribbon 1500 may be used for, inter alia, one- or two-sided thermal transfer printing of print media, such as a first and/or a second side 202, 204 of one-sided thermal transfer media 100, or a first and/or a second side 302, 304 of two-sided thermal transfer media 300.

In a thermal transfer printer such as the two-sided thermal transfer printer 1400 of FIG. 14, a two-sided thermal transfer ribbon 1500 may be supported on supply 1430 and take-up/rewind 1440 reels or supports within the printer 1400, which reels or supports may additionally maintain a desired or required tension on the ribbon 1500 during printer 1400 operation. Additionally or alternatively, a two-sided thermal transfer ribbon 1500 may be provided in cartridge form including, inter alia, one or more supply 1430 and/or take-up/rewind 1440 reels or supports, and/or guides 1420.

A substrate 1510 of a two-sided thermal transfer ribbon 1500 may comprise a fibrous or film type sheet for supporting a first and a second functional coating 1520, 1530. Additionally, the substrate 1510 may comprise one or more natural (e.g., cellulose, cotton, starch, and the like) or synthetic (e.g., polyethylene, polyester, polypropylene, and the like) materials.

In order to control characteristics of, including print quality resulting from, a two-sided thermal transfer ribbon 1500, a predetermined thickness of a substrate 1510 of a two-sided thermal transfer ribbon 1500, different from that of a single sided thermal transfer ribbon 100, which is typically 18 gauge or 4.5 micrometer thick, may be necessary. In one embodiment, a substrate 1510 of a two-sided thermal transfer ribbon 1500 is provided in the form of a 20 gauge (re. 5 micrometer thick) polyethylene terephthalate (PET) film. In another embodiment, a substrate 1510 of a two-sided thermal transfer ribbon 1500 is provided in the form of a 16 gauge (re. 4 micrometer thick) PET film.

In one embodiment, thickness of a substrate 1510 and/or a first and a second thermal transfer coating 1520, 1530, and/or the physical and/or chemical properties thereof, may be selected such that thermal conductance of the substrate 1510 and/or a first functional or thermal transfer coating 1520 supported on a first side 1512 thereof is sufficiently high to permit heat applied to the first thermal transfer coating 1520 through, for example, a first surface 1502 of the two-sided thermal transfer ribbon 1500, to melt a second functional or thermal transfer coating 1530 supported on a second side 1514 of the substrate 1510, opposite the first side 1512. In other embodiments, it may further be desired or required that the first thermal transfer coating 1520 not melt or otherwise delaminate from the substrate 1510 when sufficient heat is applied thereto to melt the second thermal transfer coating 1530.

It should be noted that, where provided, thickness and/or physical and/or chemical properties of one or more additional coatings, such as one or more sub coats 1540, 1550, may be factored into the above described embodiments such that, for example, thermal conductance of the substrate 1510, a first functional or thermal transfer coating 1520, and first and second sub coats 1540, 1550 associated with a two-sided thermal transfer ribbon 1500 is sufficiently high to permit heat applied to, for example, a first surface 1502 of the two-sided thermal transfer ribbon 1500, to melt a second functional or thermal transfer coating 1530 supported on a second side 1514 of the substrate 1510, opposite the first side 1512. Likewise, in other embodiments, it may be desired that such applied heat does not, for example, also melt or delaminate the first thermal transfer coating 1520, the first sub coat 1540, the substrate 1510, and/or the second sub coat 1550.

In another embodiment, thickness of a substrate 1510 and/or a thermal transfer coating 1520, 1530, and/or the physical and/or chemical properties thereof, may be selected such that thermal resistance of the substrate 1510 and/or a first functional or thermal transfer coating 1520 supported on a first side 1512 thereof is sufficiently high to prohibit heat applied to the first thermal transfer coating 1520 through, for example, a first surface 1502 of the two-sided thermal transfer ribbon 1500, sufficient to melt the first thermal coating 1520, to melt or otherwise delaminate a second functional or thermal transfer coating 1530 supported on a second side 1514 of the substrate 1510, opposite the first side 1512. Variations, including embodiments including one or more sub coats 1540, 1550, are possible.

In some embodiments, first and second functional coatings 1520, 1530 of a two-sided thermal transfer ribbon 1500 may be adapted to melt or otherwise transfer at different temperatures such that, for example, a first thermal transfer coating 1520 transfers or melts at temperature T1 greater than a transfer or melt temperature T2 of a second thermal transfer coating 1530, and vice-versa. Such coatings may be selected in order to, for example, avoid premature melting and/or transfer of a first coating 1520 upon heating of a two-sided thermal transfer ribbon 1500 for transfer of a second coating 1530, and vice-versa. In one embodiment, a first thermal transfer coating 1520 melts or otherwise transfers at a temperature 10 to 50 degrees Celsius higher than a second thermal transfer coating 1530. In another embodiment, a first thermal transfer coating 1520 melts or otherwise transfers at a temperature 10 to 20 degrees Celsius higher than a second thermal transfer coating 1530.

A functional coating 1520, 1530 of a two-sided thermal transfer ribbon 1500 may comprise a dye and/or pigment bearing substance which is transferred to receptive media (e.g., cardboard, paper, film, and the like) upon application of heat, by which printing is provided. A functional coating 1520, 1530 may comprise a wax (e.g., carnauba, paraffin, and the like), resin (e.g., urethane, acrylic, polyester, and the like), or a combination of the two, having one or more dyes (e.g., a leuco dye, methyl violet, and the like) and/or pigments (e.g., carbon black, iron oxide, inorganic color pigments, and the like) incorporated therein. In one embodiment, one or both functional coatings 1520, 1530 of a two-sided thermal transfer ribbon 1500 comprise 65-85% carnauba and/or paraffin wax, 5-20% carbon black pigment, and 5-15% ethylene vinyl acetate (EVA) resin. In a further embodiment, one or both functional coatings 1520, 1530 of a two-sided thermal transfer ribbon 1500 comprise 40% carnauba, 40% paraffin wax, 15% carbon black pigment, and 5% ethylene vinyl acetate (EVA) resin.

Depending on the application, composition of the first and second functional coatings may be different. For example, as discussed above, composition of a first and a second functional coating 1520, 1530 may be selected such that the first functional coating 1520 transfers (e.g., melts) at a different temperature than a second functional coating 1530 through, for example, selection of coating constituent materials, relative percentages thereof, additives, and the like. In one embodiment, a first thermal transfer coating 1520 may comprise a predominantly wax based formulation while a second thermal transfer coating 1530 may comprise a predominantly resin based formulation. In some embodiments, a first thermal transfer coating 1520 may predominantly comprise a carnauba wax and a second thermal transfer coating 1530 may predominantly comprise an acrylic resin. In other embodiments, a first thermal transfer coating 1520 may predominantly comprise a paraffin wax and a second thermal transfer coating 1530 may predominantly comprise a polyester resin.

As shown in FIG. 15, a two-sided thermal transfer ribbon 1500 may further comprise a sub coat 1540, 1550 situated between respective surfaces 1512, 1514 of the substrate 1510 and either or both of a first and a second functional coating 1520, 1530. Where provided, a sub coat 1540, 1550 may aid in adhering and/or releasing the functional coatings 1520, 1530 to and/or from the substrate 1510, and/or may protect the substrate 1510 from damage due to application of heat for printing (e.g., warping, curling, melting, burn-thru, and the like). A sub coat 1540, 1550 may comprise a wax (e.g., carnauba, paraffin, and the like), resin (e.g., urethane, acrylic, polyester, and the like), or a combination of the two, and may include one or more release and/or slip agents (e.g., polytetrafluoroethylene (PTFE), silicone, and the like). In one embodiment, a sub coat 1540, 1550 comprises 60% carnauba wax, 30% paraffin wax, and 10% PTFE. In another embodiment, a sub coat 1540, 1550 comprises a water based or ultra-violet (UV) light cured silicone. In some embodiments, the composition of a first sub coat 1540 is different from the composition of a second sub coat 1550.

In other embodiments, one or more thermal barriers, heat reflectors and/or absorbers may be desired or required as part of a two-sided thermal transfer ribbon 1500.

Likewise, as described with respect to a one-sided thermal transfer ribbon 100 of FIG. 12 hereinabove, a two-sided thermal transfer ribbon 1500 may include one or more sense marks 1210, 1212, 1214, 1216 on a first and/or a second side 1502, 1504 thereof. Such sense marks 1210, 1212, 1214, 1216 may be used for, inter alia, registration of a two-sided thermal transfer ribbon 1500 with respect to a first and/or a second thermal print head 810, 815, 910, 915, 1110, 1115, 1310, 1315, 1410, 1415, 1710, 1715, 1810, 1815 of a one- or two-sided thermal transfer printer 800, 900, 1100, 1300, 1400, 1700, 1800, and/or tracking of regions of a first and/or a second coating 1520, 1530 of such ribbon 1500 which have been used for printing and/or are remaining to be used for printing for, for example, maximization of use of the thermal transfer coatings 1520, 1530 of such ribbon 1500.

Where provided, the one or more sense marks may comprise one or more inks, dyes, luminescent markers (including fluorescent and/or phosphorescent inks and dyes), perforations, holes, cut-outs, notches, regions lacking one or more functional coatings 1520, 1530, and the like, which are discernable against a background of a first and/or a second thermal transfer coating 1520, 1530, and/or substrate 1510, of a two-sided thermal transfer ribbon 1500 by one or more sensors 870, 871, 872, 873, 874, 875, 876, 877, 970, 971, 972, 973, 974, 975, 976, 977, 1170, 1172, 1370, 1372, 1471, 1472, 1474 associated with a one- or two-sided thermal transfer printer 800, 900, 1100, 1300, 1400, 1700, 1800.

As further shown in FIG. 14, a two-sided thermal transfer printer 1400 may include first and second platens 1450, 1455 on opposite sides 304, 302 of the media 300 and feed path 1405 thereof proximate to first and second print heads 1410, 1415 in order to, for example, maintain contact between the print heads 1410, 1415, print media 300, and thermal transfer ribbon 1500 during printer 1400 operation. As shown in FIG. 14, the first platen 1450 comprises a roller-type (e.g., cylindrical) platen while the second platen 1455 comprises a plate-type platen, although either or both platens may comprise rollers or plates. Where provided, a plate-type platen 1455 may further include tapered leading and/or trailing edges in order to mitigate against damage to the media 300 and thermal transfer ribbon 1500 as they traverses the platen 1455.

Depending on the printer design and/or application, print media such as the two-sided thermal transfer media 300 of FIG. 3 may be supplied in the form of a roll 360, fan-fold stock, individual (cut) sheets, and the like, upon which information in text and/or graphic form may be printed on one or both sides 302, 304 thereof to provide, for example, a voucher, coupon, receipt, ticket, label, or other article or document.

A two-sided thermal transfer printer 1400 may further include one or more rollers or other guides 1420 for, inter alia, guiding thermal transfer media 300 and/or thermal transfer ribbon 1500 along respective media and ribbon feed paths 1405, 1407 through the printer 1400. Additionally or alternatively, some or all of such rollers 1420 may provide means for transporting the ribbon 1500 and/or media 300 through the printer 1400, and/or maintaining a desired tension of the ribbon 1500 and/or media 300, alone or in combination with one or more supply 1430 and take-up/rewind 1440 reels or supports, platens 1450, 1455, drive systems 1490, and the like.

A drive system 1490 associated with a two-sided thermal transfer printer 1400 may provide for transportation of print media, such as the two-sided thermal transfer media 300 of FIG. 3, and/or thermal transfer ribbon, such as the two-sided thermal transfer ribbon 1500 of FIG. 15, through the printer 1400 during printer operation. Depending on the design and/or application, a drive system 1490 may comprise one or more motors (e.g. stepper, servo, and the like) (not shown) for powering a system of gears, links, cams, belts, wheels, pulleys, rollers, combinations thereof, and the like, in operative contact with the media 300 and/or thermal transfer ribbon 1500. In one embodiment, a drive system 1490 comprising a stepper motor (not shown) and one or more gears (not shown) adapted to rotate a first platen 1450 and one or more rollers 1420 each provided in the form of a circular cylinder is provided to transport media 300 and ribbon 1500 through the two-sided thermal transfer printer 1400. In alternate embodiments, a drive system 1490 comprising a stepper motor (not shown) operatively connected to one or more dedicated drive (e.g., non-platen) rollers, such as any of the guide rollers 1420, and/or one or both of the ribbon 100 supply 1430 and/or take-up 1440 rollers or supports may be provided.

As shown in FIG. 14, a two-sided thermal transfer printer 1400 comprising a two-sided thermal transfer ribbon 1500 may include one or more sacrificial surfaces or substrates 1480 for preventing a functional coating 1530 on a second side 1504 of a two-sided thermal transfer ribbon 1500 from building up on or otherwise contaminating a first thermal print head 1410 while heat is applied by such head to the ribbon 1500 for printing on a first side 302 of media 300. In one embodiment, a substrate 1480 is provided between a second surface 1504 of a two-sided thermal transfer ribbon 1500 and a first thermal print head 1410 such that any of the second functional coating 1530 melted and/or released through application of heat by the first thermal print head is captured on the substrate 1480 and/or remains on (e.g., is pressed against and allowed to re-solidify and/or cool for maintaining adherence to) the second side 1504 of the two-sided thermal transfer ribbon 1500. In such embodiment, the substrate 1480 may comprise a continuous sheet and/or film of media provided on a supply roll 1485 for co-feeding and take-up 1440 with a two-sided thermal transfer ribbon 1500 as such ribbon traverses the first thermal print head 1410. In some embodiments, a separate take-up reel or means (not shown) specific to the substrate may also be provided.

In an alternate embodiment, a sacrificial surface or substrate 1480 may comprise a continuous loop of sheet and/or film media or other material adapted to capture any of the second functional coating 1530 that is released by virtue of application of heat by the first thermal print head 1410. In such embodiment, cleaning means such as a brush, scrapper, and the like (not shown) may be provided to continuously clean the sacrificial surface or substrate 1480 for continuous use.

In a further embodiment, a sacrificial surface or substrate 1480 may comprise a fixed surface adapted to prevent transfer of a second functional coating 1530 from a second side 1504 of a two-sided thermal transfer ribbon 1500 from building up on or otherwise contaminating a first thermal print head 1410. In such embodiment, a sacrificial surface or substrate may comprise one or more low friction materials such as, but not limited to, silicone and/or polytetrafluoroethylene (PTFE), which provide a barrier between a first thermal print head 1410 and a second side 1504 of a two-sided thermal transfer ribbon 1500 such that any functional coating released (e.g., melted) by virtue of application of heat from the first thermal print head 1410 is maintained and/or pressed against the second side 1504 of the two-sided thermal transfer ribbon 1500 for a sufficient time after application of said heat such that the released functional coating 1530 cools and maintains attachment and/or reattaches to the second side 1504 of the two-sided thermal transfer ribbon 1500. Combination and/or variation of the above embodiments for avoiding build-up on and/or contamination of a first thermal print head 1410 with a function coating 1530 from a two-sided thermal transfer media 1500 are possible.

In alternate embodiments, a two-sided thermal transfer printer 1400 may also include first and second support arms (not shown) for supporting some or all of the first and second print heads 1410, 1415, first and second platens 1450, 1455, thermal transfer ribbon 1500 supply 1430 and/or take-up rollers or supports 1440, any or all of the rollers 1420 used for, inter alia, guiding, feeding, and/or tensioning the media 300 and/or thermal transfer ribbon 15, sacrificial media supply roll 1485, and the like. Additionally, as illustrated in, and discussed in regard to, FIGS. 7, 8 and 9, where provided, the support arms may further be in fixed or pivotable relation to one another.

As additionally shown in FIG. 14, a two-sided thermal transfer printer 1400 may further include a controller 1460 for controlling operation of the printer 1400. As described with regard to the two-sided direct thermal printer 700 of FIG. 7, and the two-sided thermal transfer printer 1100 of FIG. 11, the controller 1460 may comprising, inter alai, a communication controller 1462, one or more buffers or memory elements 1464, a processor 1466, and/or a printing function switch 1468, each of which may perform one or more functions and/or operations consistent with the counterpart components described with regard to FIGS. 7 and 11 hereinabove.

In operation, data received for printing by a two-sided direct thermal, two-sided thermal transfer, and/or combined two-sided direct thermal and thermal transfer printer 700, 800, 900, 1100, 1300, 1400 may be split and/or otherwise designated for printing by a first and/or a second print head 710, 720, 810, 815, 910, 915, 1110, 1115, 1310, 1315, 1410, 1415 prior to being provided to the two-sided printer by, for example, a printing function switch 768, 868, 968, 1168, 1368, 1468 associated with the two-sided printer, and/or an application program or print driver running on an associated host terminal or computer (not shown), and the like, as described in, for example, U.S. patent application Ser. No. 11/675,649 entitled "Two-Sided Thermal Print Switch" and filed on Feb. 16, 2007, and U.S. patent application Ser. No. 11/765,605 entitled "Two-Sided Print Data Splitting" and filed on Jun. 20, 2007, the contents of which are hereby incorporated by reference herein.

Depending on the printer and/or application, it may be desired or required to identify data for printing by a particular print head and/or print means based on a type of data provided. For example, where lines of text and/or character (e.g., ASCII, Kanji, Hanzi, Hebrew, Arabic, and the like) data are provided for printing, such data may preferentially be selected for printing by direct thermal means. Likewise, where graphic (e.g., raster, bitmap, vector, and the like) data is provided, such as a bar code, such data may be preferentially be selected or otherwise apportioned for printing by thermal transfer means.

In one embodiment, combined text and graphic data may be received by a communication controller 962 associated with a combined two-sided direct thermal and thermal transfer printer 900. As such data is received, it may be stored in one or more received data memory or buffer elements 964. Upon receipt of a end-of-page, transmission, transaction, or other like command, the stored data may then be apportioned for printing by one or both of the direct thermal 915 and/or thermal transfer 910 print heads based on a type of data provided by one or both of a processor 966 and/or printing function switch 968 associated with the printer 900. Stored text data may then be identified and selected for printing by the direct thermal print head 915 while stored graphic data may be identified and selected for printing by the thermal transfer print head 910, wherein being identified and selected for printing may comprise identifying an appropriate portion of the received print data as text data and storing such data in an respective text data memory region or buffer 964 for printing via a direct thermal print head 915, and identifying an appropriate portion of the received print data as graphic data and storing such data in a respective graphic data memory region or buffer 964 for printing via a thermal transfer print head 910. Alternately some or all of the received print data may be identified as graphic and/or text data in advance of its receipt by a combined two-sided direct thermal and thermal transfer printer 900, which data may then be stored in respective text and graphic data memory regions 964 for printing via respective direct thermal and thermal transfer print heads 915, 910 upon receipt.

Likewise, it may be desired or required to print a portion of received print data via one or more available means, such as one of a direct thermal and thermal transfer means, while it may be possible or permitted to print the balance of the such data via any available method, such as either or both of direct thermal and thermal transfer means. For example, in an embodiment, it may be desired or required to print received graphic data via thermal transfer means, while it may be permitted to print received text data via direct thermal and/or thermal transfer means. As such, in one embodiment, received graphic data may be designated for printing by, for example, a thermal transfer print head 910 associated with a combined two-sided direct thermal and thermal transfer printer 900, while received text data may be selected for printing by either or both of a direct thermal print head 915 and/or the thermal transfer print head 910 of the combined two-sided direct thermal and thermal transfer printer 900.

In some embodiments, a quantity of text data identified for printing via thermal transfer means along with any received graphic data is selected such that the combined thermal transfer printed text and graphic data occupies a similar length of media as the remaining quantity of text data, thereby providing for a nearly uniform split of received data for printing on a first media side (e.g., approximately one half) via thermal transfer means as for printing on a second media side (e.g., approximately one half) via direct thermal means. For example, as illustrated with regard to the receipt 600 of FIG. 6, a first portion of transaction information 620 in the form of text data may be identified for and printed on a first side 602 of, for example, combined two-sided direct thermal and thermal transfer media 1000 comprising the receipt 600 via direct thermal means, while a second portion of the transaction information 620 in the form of text data along with the discount offer 650 and bar code 660 is identified for and printed on a second side 604 of the combined two-sided direct thermal and thermal transfer media 1000 comprising the receipt 600, wherein the length of media 1000 occupied by the text information printed on the first side 602 of the receipt 600 is roughly equivalent to the length of media 1000 occupied by the text and graphic information printed on the second side 604 of the receipt 600.

Variations on and/or combinations of the above described methods for apportioning text and/or graphic data for printing by one or both of direct thermal and/or thermal transfer means, such as, for example, where some or all of received graphic and/or text data is identified for printing in advance of receipt by a combined direct thermal and thermal transfer printer 900 and the balance is identified as text and/or graphics by a processor 966 or printing function switch 968 associated with the printer 900, or particular graphic information (e.g., a header and/or store identifier 610 or corporate logo) is permitted to be printed along with text information 620 via direct thermal means while other graphic information (e.g., a bar code 660) is permitted to be printed via only thermal transfer means, are also possible.

In additional embodiments, a two-sided thermal transfer ribbon 1500 may be used for thermal transfer printing using one of two available functional coatings 1520, 1530, and then rewound, removed, and/or turned over, reinserted, and re-run for thermal transfer printing using the other of two available functional coatings 1530, 1520. Likewise, in some embodiments, a one- or two-sided thermal transfer ribbon 100, 1500 may be provided in cartridge form for, for example, operator convenience, and ease of loading. Where utilized, a cartridge may comprise supply 830, 835, 930, 1130, 1330, 1430 and/or take-up/rewind 840, 845, 940, 1140, 1340, 1440 reels or supports, rollers or other guides 1120, 1320, 1420 and/or a turn bar assembly 1325 as required or desired for a particular printer 800, 900, 1100, 1300, 1400 configuration.

In some embodiments, a thermal transfer printer such as any of the printers 800, 900, 1100, 1300, 1400 illustrated in FIGS. 8, 9, 11, 13, and 14 may include hardware, software and/or firmware executed on or via, for example, one or more of a processor 866, 966, 1166, 1366, 1466, and/or a printing function switch 868, 968, 1168, 1368, 1468, that identifies, tracks and/or otherwise recognizes a portion of a one- or two-sided thermal transfer ribbon 100, 1500 that has been used for printing, and a portion which has not. Such system may be used to control unwinding and/or rewinding of a one- or two-sided thermal transfer ribbon 100, 1500 to maximize use of functional coatings 120, 1520, 1530 associated with such ribbons. In one embodiment, one or more sensors 870, 871, 872, 873, 874, 875, 876, 877, 970, 971, 972, 973, 974, 975, 976, 977, 1170, 1172, 1370, 1372, 1471, 1472, 1474 may be used to identify portions of a one- or two-sided thermal transfer ribbon 100, 1500 have been used for printing and which portions have not such that the ribbon 100, 1500 may be appropriately unwound and/or rewound for utilizing the identified, unused portions. Likewise, in other embodiments, one or more sense marks 1210, 1212, 1214, 1216 may be provided on a one- or two-sided thermal transfer ribbon 100, 1500 for identifying and/or tracking portions of a ribbon 100, 1500 that have been used for printing and which portions have not, as well as permitting registration of the same with a first and/or a second print head, thereby facilitating unwinding and/or rewinding of the ribbon 100, 1500 for utilization of unused portions.

In some embodiments, lifting and/or traversing print heads off of and/or away from and edge of print media may be provided to decouple printing by a thermal transfer printer 800, 900, 1100, 1300, 1400 from motion of an associated thermal transfer ribbon 100, 1500. Such system may be required or desired where a thermal transfer ribbon moves relative and/or counter to print media for some or all its motion such as, for example, in the two-sided thermal transfer printer 1100 illustrated in FIG. 11, and/or where unwind and/or rewind of such ribbon is provided for as described hereinabove.

Further, in various embodiments, bowed rollers, web guides, improved tension control, nip rollers, and/or related, individual drive motors may be incorporated in a thermal transfer printer 800, 900, 1100, 1300, 1400 to mitigate problems associated with ribbon 100, 1500 distortion and/or wrinkling.

In still other embodiments, a two-sided thermal transfer and/or combined direct thermal and thermal transfer printer 800, 900, 1100, 1300, 1400 may be used to print both a removable label (e.g., a face sheet comprising one or more adhesives such as a pressure sensitive glue) and an associated label liner (e.g., a back sheet coated with one or more release agents such as silicone). For example, depending on the printer, direct thermal means may be used to preferentially print the label while thermal transfer means may be used to preferentially print the associated liner, and vice-versa, or thermal transfer means may be used to print both the label and liner portions, allowing for use of an otherwise disposable liner.

Figure 16:
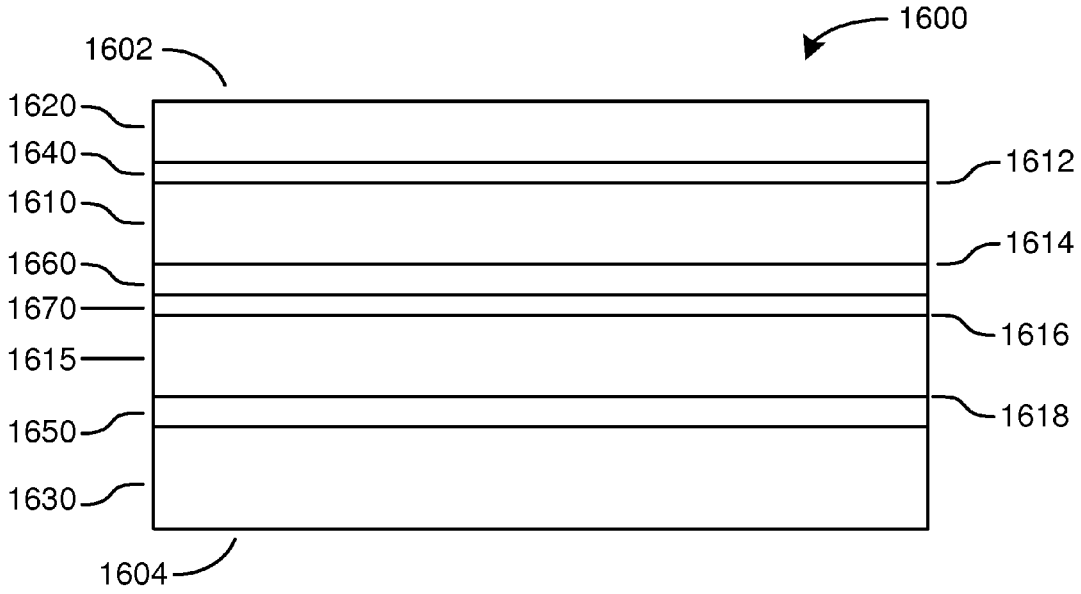
FIG. 16 provides a cross-sectional view of two-sided thermal media comprising a label and liner combination for, inter alia, two-sided direct thermal and/or thermal transfer printing thereof.

FIG. 16 illustrates a cross-sectional view of two-sided thermal media comprising a label and liner combination 1600 for printing by a two-sided thermal transfer and/or combined direct thermal and thermal transfer printer 800, 900, 1100, 1300, 1400. As shown in FIG. 16, the liner and label combination 1600 may comprise a first substrate 1610 having a first side 1612 and a second side 1614, and a second substrate 1615 having a first side 1616 and a second side 1618. Either or both of the substrates 1610, 1615 may comprise a fibrous or film type sheet each of which may further comprise one or more natural (e.g., cellulose, cotton, starch, and the like) and/or synthetic (e.g., polyethylene, polyester, polypropylene, and the like) materials. In one embodiment, first and second substrates 1610, 1615 of a label and liner combination 1600 are provided in the form of a non-woven cellulosic (e.g., paper) sheet.

As further shown in FIG. 16, the first substrate 1610 may include a thermally sensitive coating 1620 on at least a first side 1612 thereof. Where provided, a thermally sensitive coating 1620 may comprise a full, spot or pattern coating, and may provide for single or multi-color direct thermal printing therein. Further, a thermally sensitive coating 1620 may comprise at least one dye and/or pigment, and one or more activating agents, which undergo a color change upon the application of heat as described hereinabove.

As also shown in FIG. 16, the second substrate 1615 may include a thermal transfer receptive coating 1630 on a second side 1618 thereof. A thermal transfer receptive coating 1630 may comprise one or more materials for preparing a respective surface 1604 of the liner and label combination 1600 to accept transfer of a functional coating 120, 1520, 1530 from a thermal transfer ribbon 100, 1500 as described hereinabove.

In other embodiments, a label and liner combination 1600 may include a thermally sensitive coating 1620, 1630 or a thermal transfer receptive coating 1620, 1630 on a first side 1612 of a first substrate 1610 and a second side 1618 of a second substrate 1615 for, inter alia, two-sided direct thermal or two-sided thermal transfer printing of respective sides 1602, 1604 of the label and liner combination 1600.

In some embodiments, each of the first and/or second substrates 1610, 1615 of a label and liner combination 1600 may further include one or more base 1640, 1650 and/or top coats (not shown) associated with their respective first and/or second sides 1612, 1614, 1616, 1618. Where included, the one or more base 1640, 1650 and/or top coats may be respectively provided under and/or on top of one or more included thermally sensitive and/or thermal transfer receptive coatings 1620, 1630. Suitable materials for use as a base 1640, 1650 and/or top coat of a label and liner combination 1600 are as disclosed hereinabove.

As shown in FIG. 16, a liner and label combination 1600 may further comprise one or more adhesive layers 1660 for releasably attaching, inter alia, a second side 1614 of a first substrate 1610 to a first side 1616 of a second substrate 1615. Suitable adhesives include high tack adhesives for maintenance of residual tackiness or stickiness upon separation of the first and second substrates 1610, 1615, low tack adhesives which provide a low degree of residual tackiness or stickiness upon separation of the first and second substrates 1610, 1615, and/or no residual tack adhesives which leave no residual tackiness or stickiness upon separation of the first and second substrates 1610, 1615, and the like.

Additionally, and as shown in FIG. 16, the liner and label combination 1600 may further comprise one or more release layers or liners 1670 proximate to a first side 1616 of a second substrate 1615. Where provided, the one or more release layers or liners 1670 may assist in releasably attaching the first substrate 1610 to the second substrate 1615. Inclusion of a release layer or liner 1670 may vary with a type of adhesive 1660 used. For example, inclusion of a release layer or liner 1670 may be desired or required with use of a high tack adhesive 1660, but optional where a low and/or no tack adhesive 1660 is used.

In one embodiment, a high tack hot melt adhesive 1660 is applied to a second side 1614 of a first substrate 1610 having a thermally sensitive coating 1620 on a first side 1612 thereof, and a silicone release agent 1670 is applied to a first side 1616 of a second substrate 1615 having a thermal transfer receptive coating 1630 on a second side 1618 thereof such that, when removed from the second substrate 1615, the first substrate 1610 acts as a adhesive direct thermal label and the second substrate 1615 acts as a thermal transfer liner. In alternate embodiments, a silicone release agent 1660 is applied to a second side 1614 of a first substrate 1610 having a thermally sensitive coating 1620 on a first side 1612 thereof, and a medium tack pressure sensitive adhesive 1670 is applied to a first side 1616 of a second substrate 1615 having a thermal transfer receptive coating 1630 on a second side 1618 thereof such that, when removed from the second substrate 1615, the first substrate 1610 acts as a direct thermal liner and the second substrate 1615 acts as an adhesive thermal transfer label. Variations are possible.

As previously described, thermal printing may comprise direct thermal and/or thermal transfer printing of one or both sides of provided media. In the case of media comprising a single substrate, such as any of the media 200, 300, 400, 500 of FIGS. 2, 3, 4 and 5, thermal printing may occur via direct thermal and/or thermal transfer printing of one or both sides 202, 204, 302, 304, 402, 404, 502, 504 of the media 200, 300, 400, 500. Likewise, in the case of media comprising two or more substrates, thermal printing may occur via direct and/or thermal transfer printing of one or both sides of each of the constituent substrates. For example, in the case of a label and liner combination, such as the label and liner combination 1600 of FIG. 16, thermal printing may occur via direct and/or thermal transfer printing on or proximate to a respective first side 1612, 1618 of first and second substrates 1610, 1615 comprising the label and liner combination 1600. In other embodiments, direct thermal and/or thermal transfer printing may occur on or proximate to one or both sides 1612, 1614, 1616, 1618 of the first and second substrates 1610, 1615 comprising multi-substrate media such as the two-sided label and liner combination 1600 of FIG. 16.

It should be noted that direct thermal printing may occur only where a suitable direct thermally sensitive coating 420, 520, 550, 1640, 1650 is provided, such on or proximate to any of the as of the first side 402 of the single-sided direct thermal media 400 of FIG. 4, the first and second sides 502, 504 of the two-sided direct thermal media 500 of FIG. 5, and the first and second sides 1602, 1604 of the two-sided label and liner combination 1600 of FIG. 16. However, while, as previously noted, a specific thermal transfer receptive coating or treatment may not be expressly required for thermal transfer printing to occur, problems with thermal transfer printing may arise where no thermal transfer receptive coating or treatment is provided on a given surface. Such problems may include, but are not limited to:

i. poor print quality via wax and/or wax and resin based thermal transfer ribbons;

ii. an inability to print via resin based thermal transfer ribbons at all;

iii. ready smear and/or scratch off of thermal transfer print produced via wax and/or wax and resin based thermal transfer ribbons;

iv. an inability to maintain an acceptable print quality at an acceptable printing speed (i.e. 6-10 inches per second);

v. an inability to produce barcodes of an acceptable grade (e.g., higher than ANSI "C"); and vi. an inability to print at low print head energies (e.g., pulse duration), especially via wax thermal transfer ribbons.

Likewise, for a label and liner combination, such as the label and liner combination 1600 of FIG. 16, once the label portion of the combination is removed (e.g., 1610, 1620, 1640, 1660), the liner portion (e.g., 1615, 1630, 1650, 1670) may curl, making the liner difficult to handle and any image produced thereon via two sided direct and/or thermal transfer printing difficult to read.

As previously noted hereinabove, some or all of the above described problems with thermal transfer printing may be mitigated and/or eliminated through use of one or more thermal transfer receptive coatings, chemistries and/or treatments of some or all of a particular media surface on which it is desired or required to apply thermal transfer print. Suitable coatings, chemistries and/or treatments include, but are not limited to:

i. Clay Type Coating

In some embodiments, a clay type coating (e.g., kaolinite, montmorillonite, illite, and/or chlorite) may be applied to a surface in advance of thermal transfer print thereon to ameliorate some or all of the above described problems with thermal transfer printing such as, but not limited to, providing for excellent print quality, high print speeds, low print energies, good scratch and smear characteristics, and high ANSI bar code grades (e.g., greater than or equal to ANSI "C") for wax, and wax and resin thermal transfer ribbon formulations.

ii. Surface Energy Modifying Coating or Treatment

In some embodiments, a surface energy modifying coating or treatment may be applied to a surface in advance of thermal transfer printing thereof to ameliorate some or all of the above described problems with thermal transfer printing such as, but not limited to, providing for excellent print quality, high print speeds, low print energies, good scratch and smear characteristics, and high ANSI bar code grades for thermal transfer printing thereon. A surface energy modifying coating or treatment may be required for thermal transfer printing via resin based thermal transfer ribbon formulations, and required or desired for thermal transfer printing via wax and/or wax and resin based ribbons.

A surface energy modifying coating or treatment modifies the surface energy of the coated and/or treated media to be greater than the surface tension of the thermal transfer (functional) coating 120, 1520, 1530 of a one- or two-sided thermal transfer ribbon 100, 1500, improving the wettability of the surface to provide for a greater contact area of the thermal transfer (functional) coating with, and adhesion of the thermal transfer (functional) coating to, the surface, thereby permitting and/or enhancing thermal transfer printing thereon.

Suitable surface energy modifying coatings may comprise a high glass transition temperature (Tg) resin that does not soften under standard thermal printing conditions (e.g., 75 to 150 degrees Celsius), which resin may be clear (e.g., a varnish) or colored (e.g., an ink) depending on the end-use and/or the required or desired print effect. Such coating and related carrier materials may typically be spot, strip or flood coated on a surface. Likewise, such coating and related carrier may be "printed" in the form of text and/or a graphic image on a surface such that thermal transfer print will preferentially or only occur above the printed text and/or image.

In addition to the use of coatings, additional surface processing and/or treatments means for modifying surface energy may be used such as calendaring or supercalendaring, corona discharge and/or plasma treatment. Such means modify surface energy by, inter alia, decreasing irregularities in, and/or modifying composition of, a print surface.

In one embodiment, a surface energy modifying coating comprising, for example, a high glass transition temperature resin, is used to provide a surface energy in the range of 30 to 75 dynes per centimeter, ideally 45 to 50 dynes per centimeter, for enhancing thermal transfer printing thereon.

iii. Low Glass Transition Temperature Coating

In some embodiments, a low glass transition temperature (Tg) coating (e.g., a coating having a glass transition temperature in range of thermal print head operation, e.g., typically 50 to 150 degrees Celsius, ideally 70 to 90 degrees Celsius) may be applied to a surface in advance of thermal transfer print thereon to ameliorate some or all of the above described problems with thermal transfer printing such as, but not limited to, providing for excellent print quality, high print speeds, low print energies, good scratch and smear characteristics, and high ANSI bar code grades for thermal transfer printing thereon. A low glass transition temperature coating allows and/or enhances transfer of resin, wax, and/or wax and resin based thermal transfer ribbons.

Suitable low glass transition temperature coatings may comprise a resin (e.g., urethane, acrylic, polyester, and the like) that softens (e.g., becomes tacky) and/or melts when heat is applied during thermal transfer printing. In some embodiments, a low glass transition temperature coating may be used to modify the surface energy of a surface such that thermal transfer printing is encouraged as described hereinabove. In other embodiments, a low glass transition temperature coating may, when softened and/or melted, may cohesively attract a thermal transfer (functional) coating 120, 1520, 1530, thereby assisting in the removal of such thermal transfer (functional) coating 120, 1520, 1530 from an associated thermal transfer ribbon 100, 1500, and the bonding of the thermal transfer (functional) coating to the low glass transition temperature coated media. In still further embodiments, a low glass transition temperature coating may be selected such that the coating additionally or alternatively melts upon application of heat by a thermal print head during thermal transfer printing such that a thermal transfer or functional coating of an associated thermal transfer ribbon mixes and/or blends with the molten coating creating a new, co-mixed (e.g., thermal transfer ribbon function coating plus low glass transition temperature coating) material on the surface of the media.

iv. Direct Thermal Coating

In some embodiments, a thermally sensitive (re. direct thermal) coating may be applied to a surface in advance of thermal transfer printing thereon to ameliorate some or all of the above described problems with thermal transfer printing such as, but not limited to, providing for excellent print quality, high print speeds, low print energies, good scratch and smear characteristics, and high ANSI bar code grades. In some embodiments, a thinner direct thermal coating (e.g., approximately 1-2 grams per square meter) may be suitable for use in enhancing thermal transfer print on a surface than commonly used for direct thermal printing alone (e.g., approximately 5 grams per square meter). As will be described further hereinbelow, use of a direct thermal coating on a media side designated for thermal transfer printing permits, inter alia, direct thermal imaging of the media in regions where heat is applied for thermal transfer printing, and vice-versa. As a result, such media may provide for direct thermal printing in regions of the media where thermal transfer printing occurs, thereby providing redundant (e.g., thermal transfer over direct thermal) printing and ameliorating issues associated with poor adhesion and/or physical removal (e.g., scratch, smear, abrasion, etc) of the thermal transfer print.

Likewise, media comprising a direct thermal thermally sensitive coating may provide for direct thermal printing in regions of the media where a functional coating 120, 1520, 1530 of a thermal transfer ribbon 100, 1500 does not sufficiently or efficiently transfer and/or adhere. Thus, in regions where thermal transfer printing is uneven, sparse, spotty, irregular, poorly bonded, and/or otherwise of low print quality, and the like, a direct thermally sensitive coating adapted to image at a temperature sufficient for thermal transfer printing to occur, may image and/or fill-in (e.g., turn black) the regions of uneven, sparse, spotty, irregular, poorly bonded, and/or low quality thermal transfer print.

In some embodiments, a direct thermal thermally sensitive coating may be provided in a color selected to match or otherwise resemble a color of an associated thermal transfer (functional) coating, thereby providing for single-color thermal printing. In other embodiments, a direct thermal thermally sensitive coating may be provided in a color selected to be different from a color of an associated thermal transfer (functional) coating, thereby providing for multi-color thermal printing. Such multi-color printing may result from separate thermal transfer and/or direct thermal printing in their respective colors, and/or through one or more composite colors made possible through superimposing thermal transfer print in one or more colors or shades on top of direct thermal print in one or more colors or shades.

It should be noted that in some embodiments, one or more of the above described thermal transfer receptive coatings or treatments (e.g., clay, surface energy modifying, and low glass transition temperature) may be provided in addition to (e.g., as a base and/or a top coat) a direct thermal thermally sensitive coating to further enhance thermal transfer printing.

In some embodiments, media comprising one or more direct thermal thermally sensitive coatings on one or more sides thereof may be provided such that at least one of the one or more direct thermal thermally sensitive coatings image at a different temperature than that required for transference of a thermal transfer (functional) coating associated with a one- or two-sided thermal transfer ribbon 100, 1500 during thermal transfer printing thereof. For example, in some embodiments, media comprising one or more direct thermal thermally sensitive coatings may be selected such that one or more of the one or more direct thermal thermally sensitive coatings image at a temperature lower than that required for thermal transfer printing to occur. As such, heat applied at a first temperature by a thermal print head 810, 815, 910, 1110, 1115, 1310, 1315, 1410, 1415, 1710, 1715, 1810, 1815 associated with a thermal transfer capable printer 800, 900, 1100, 1300, 1400, 1700, 1800 may be transmitted through an associated thermal transfer ribbon 100, 820, 825, 920, 1500 and image a direct thermal coating on an associated media side without transferring an associated thermal transfer (functional) coating to the media. Likewise, heat applied at a second temperature, higher than the first temperature, by the thermal print head 810, 815, 910, 1110, 1115, 1310, 1315, 1410, 1415, 1710, 1715, 1810, 1815 associated with the same thermal transfer capable printer 800, 900, 1100, 1300, 1400, 1700, 1800 may be transmitted through the associated thermal transfer ribbon 100, 820, 825, 920, 1500 such that the direct thermal coating on the associated media side images while the associated thermal transfer (functional) coating is simultaneously transferred to the media. In this manner direct thermal and/or direct thermal and thermal transfer printing may be selectively applied to one or both sides of thermal media by a thermal transfer capable printer such as any of the two-sided thermal printers 800, 900, 1100, 1300, 1400, 1700, 1800 of FIGS. 8, 9, 11, 13, 14, 17 and 18.

In other embodiments, media comprising one or more direct thermal thermally sensitive coatings may be selected such that one or more of the one or more direct thermal thermally sensitive coatings image at a temperature higher than that required for thermal transfer printing to occur. As such, heat applied at a first temperature by a thermal print head 810, 815, 910, 1110, 1115, 1310, 1315, 1410, 1415, 1710, 1715, 1810, 1815 associated with a thermal transfer capable printer 800, 900, 1100, 1300, 1400, 1700, 1800 may transfer a thermal transfer (functional) coating from an associated thermal transfer ribbon 100, 820, 825, 920, 1500 to the media without imaging a direct thermal coating on an associated media side. Likewise, heat applied at a second temperature, higher than the first temperature, by the thermal print head 810, 815, 910, 1110, 1115, 1310, 1315, 1410, 1415, 1710, 1715, 1810, 1815 associated with the same thermal transfer capable printer 800, 900, 1100, 1300, 1400, 1700, 1800 may transfer thermal transfer (functional) coating associated with the thermal transfer ribbon 100, 820, 825, 920, 1500 to the media while simultaneously imaging the direct thermal coating on the associated media side proximate to where the thermal transfer print occurs. In this manner thermal transfer and/or thermal transfer and direct thermal printing may be selectively applied to one or both sides of thermal media by a thermal transfer capable printer such as any of the two-sided thermal printers 800, 900, 1100, 1300, 1400, 1700, 1800 of FIGS. 8, 9, 11, 13, 14, 17 and 18.

Control over a temperature at which a direct thermal thermally sensitive coating 420, 520, 550, 1640, 1650 of direct thermal capable media 400, 500, 1600 images and/or a thermal transfer (functional) coating 120, 1520, 1530 of a thermal transfer ribbon 100, 1500 transfers may be provided for through control over the composition of the respective direct thermal thermally sensitive coating and thermal transfer (functional) coating. For example, a sensitizer (e.g., diphenoxyethane, parabenzylbiphenyl, and the like) associated with a direct thermal thermally sensitive coating may be selected for and/or provided in an amount to sufficient to provide for a relatively high or relatively low imaging temperature of the direct thermal thermally sensitive coating, while a base material (e.g., wax, resin, and wax and resin) composition of a thermal transfer (functional) coating, and/or a molecular weight thereof, of a thermal transfer ribbon may be selected to provide for a relatively low or high thermal transfer temperature in comparison to the temperature at which the direct thermal thermally sensitive coating will image.

In some embodiments, a direct thermal thermally sensitive coating is selected to image at a temperature 20 to 80 degrees Celsius lower than a temperature at which an associated thermal transfer (functional) coating will transfer. In others embodiments, a direct thermal thermally sensitive coating is selected to image at a temperature 30 to 50 degrees Celsius lower than a temperature at which an associated thermal transfer (functional) coating will transfer. Similarly, in some embodiments, a direct thermal thermally sensitive coating is selected to image at a temperature of 50 to 100 degrees Celsius and an associated thermal transfer (functional) coating is selected to transfer at a temperature of 100 to 150 degrees Celsius. In other embodiments, a direct thermal thermally sensitive coating is selected to image at a temperature of 60 to 80 degrees Celsius and an associated thermal transfer (functional) coating is selected to transfer at a temperature of 100 to 120 degrees Celsius.

Alternately or additionally, in some embodiments, a direct thermal thermally sensitive coating is selected to image at a temperature 20 to 80 degrees Celsius higher than a temperature at which an associated thermal transfer (functional) coating will transfer. In other embodiments, a direct thermal thermally sensitive coating is selected to image at a temperature 30 to 50 degrees Celsius higher than a temperature at which an associated thermal transfer (functional) coating will transfer. Likewise, in some embodiments, a thermal transfer (functional) coating is selected to transfer at a temperature of 60 to 110 degrees Celsius and an associated direct thermal thermally sensitive coating is selected to image at a temperature of 100 to 150 degrees Celsius. In other embodiments, a thermal transfer (functional) coating is selected to transfer at a temperature of 70 to 90 degrees Celsius and an associated direct thermal thermally sensitive coating is selected to image at a temperature of 100 to 120 degrees Celsius.

Thermal media including one or more direct thermal thermally sensitive coatings on one or more sides thereof may be used in a one- or two-sided thermal transfer capable printer, such as any of the printers 800, 900, 1100, 1300, 1400, 1700, 1800 associated with FIGS. 8, 9, 11, 13, 14, 17 and 18, wherein one or more of the provided direct thermal thermally sensitive coatings are adapted to image at a temperature higher and/or lower than a temperature at which thermal transfer is selected to occur. In one embodiment, a method of operating a thermal transfer capable printer may comprise applying heat at a first temperature to a first location of a first media side including a direct thermal thermally sensitive coating thereon through an associated thermal transfer ribbon, and applying heat at a second temperature to a second location of the first media side including a direct thermal thermally sensitive coating thereon through the thermal transfer ribbon, wherein the first temperature is selected and/or sufficient to provide for imaging of the direct thermal thermally sensitive coating at the first location without transfer of a thermal transfer (functional) coating associated with the thermal transfer ribbon and the second temperature is selected and/or sufficient to provide for imaging of the direct thermal thermally sensitive coating and transfer of a thermal transfer (functional) coating of the thermal transfer ribbon at the second location. In another embodiment, a method of operating a thermal transfer capable printer may comprise applying heat at a first temperature to a first location of a first media side including a direct thermal thermally sensitive coating thereon through an associated thermal transfer ribbon, and applying heat at a second temperature to a second location of the first media side including a direct thermal thermally sensitive coating thereon through the thermal transfer ribbon, wherein the first temperature is selected and/or sufficient to provide for transfer of a thermal transfer (functional) coating associated with the thermal transfer ribbon to the first location without imaging of the direct thermal thermally sensitive coating thereat and the second temperature is selected and/or sufficient to provide for transfer of a thermal transfer (functional) coating associated with the thermal transfer ribbon and imaging of the direct thermal thermally sensitive coating at the second location. Variations, including methods wherein the thermal transfer capable printer may apply heat to selectively print a first and a second media side via direct and/or thermal transfer means, are also possible.

As described previously hereinabove, it may be desired or required to print or otherwise image particular data and/or information via direct thermal printing and other data and/or information via thermal transfer printing. Such selective printing may be desired or required for print quality, durability, scanability, color, and like reasons, and/or to conserve and/or minimize use of consumable materials such as an associated thermal transfer print ribbon.

For example, in some embodiments, it may be desired or required to print text based data or information, such as some or all of the header 610 and/or transaction information 620 associated with the receipt 600 of FIG. 6, via direct thermal printing while it may be desired or required to print graphic based data or information, such as some or all of the discount offer 650 and/or bar code 660 of the receipt 600 of FIG. 6, via thermal transfer printing, and vice-versa. As such, in some embodiments, a thermal transfer capable printer 800, 900, 1100, 1300, 1400, 1700, 1800 may be adapted to print a first portion of received or stored print data such as, for example, text, via direct thermal means, and a second portion of the received or stored print data such as, for example, graphics, via thermal transfer means. Variations including initially selecting a first data portion comprising predominantly text for printing on a first media side and a second data portion comprising predominantly graphics for printing on a second media side by direct thermal and thermal transfer means, respectively, as previously disclosed hereinabove, while printing overlapping or duplicate data (e.g, the header information 610 and/or the portion of the transaction information 620 shown on the second side 604 of the receipt 600 of FIG. 6B) by means other than the means initially selected for the respective data portion, are also possible.

As described hereinabove, thermal printing of a particular media side may be selected to occur via direct and/or thermal transfer printing through control of an operating temperature of an associated thermal print head commensurate with the temperature at which direct thermal and/or thermal transfer printing is permitted to occur by virtue of an associated direct thermal thermally sensitive coating and/or thermal transfer (functional) coating. Where provided, such control may be effected by, for example, a controller 860, 960, 1160, 1360,

1460 and/or a printing function switch 768, 868, 968, 1168, 1368, 1468 associated with a thermal transfer capable printer 800, 900, 1100, 1300, 1400, 1700, 1800.

In general, an additional effect of any of the above described thermal transfer print enhancing coatings is that they may reduce curl of a liner from, for example, a label and liner combination 1600, after an associated label is peeled off. Rigid, resin coatings may most effectively reduce liner curl. When applied to a liner, such coating may fill the voids, cracks, and crevices in the liner, creating a rigid resin film for reducing curl of the liner. Additionally, the above described thermal transfer print enhancing coatings may be applied by one or more appropriate methods including rod coating, gravure coating, slot coating, flexographic printing, spot coating, strip coating, flood coating, and the like, to some or all of a surface upon which thermal transfer printing is desired or required to occur.

In further embodiments, one or more sensors 770, 772, 774, 776, 778, 780, 870, 871, 872, 873, 874, 875, 876, 877, 970, 971, 972, 973, 974, 975, 976, 977, 1170, 1172, 1370, 1372, 1471, 1472, 1474 may be used to identify a type of media installed in a two-sided direct thermal and/or thermal transfer printer 700, 800, 900, 1100, 1300, 1400, wherein operation of one or more printer functions may further be controlled as a result of the media type determination. In one such embodiment, an attempt may be made to image or otherwise print a first and/or a second side of installed media, and one or more sensors may subsequently be used to determine the success or failure of such attempt through identifying whether the attempted image or print exists and/or meets a required or desired quality (e.g., contrast, missing data, etc). The result of such determination may be used to identify whether one or more required or desired coatings, such as one or more thermally sensitive and/or thermal transfer receptive coatings, are provided on respective first and/or second media sides, which information may then be communicated to an operator of a printer or associated host terminal, and/or be used by a controller 760, 860, 960, 1160, 1360, 1460 associated with a two-sided thermal printer 700, 800, 900, 1100, 1300, 1400 to control operation of one or more printer functions, such as limiting direct thermal printing to surfaces identified as having an appropriate thermally sensitive coating as described in, for example, U.S. patent application Ser. No. 11/644,262 entitled "Two-Sided Thermal Print Sensing" and filed on Dec. 22, 2006 the contents of which are hereby incorporated by reference herein.

In other embodiments, one or more sensors 770, 772, 774, 776, 778, 780, 870, 871, 872, 873, 874, 875, 876, 877, 970, 971, 972, 973, 974, 975, 976, 977, 1170, 1172, 1370, 1372, 1471, 1472, 1474 associated with a two-sided thermal printer 700, 800, 900, 1100, 1300, 1400 may be used to directly identify whether a required or desired coating or finish is provided on a first and/or a second media side absent a prior print attempt. For example, in one embodiment, one or more optical sensors may be used ascertain the reflectance of one or more media sides, which ascertained reflectance may be required to meet a predetermined reflectance correlating to a particular surface coating and/or smoothness prior to permitting direct thermal and/or thermal transfer printing thereon by an associated first and/or second thermal print head by, inter alia, a printing function switch 768, 868, 968, 1168, 1368, 1468 associated with a two-sided thermal printer 700, 800, 900, 1100, 1300, 1400.

Regardless of the technique, where a required or desired coating or surface finish for a particular print method (e.g., direct thermal or thermal transfer printing) is not found, printing via an associated thermal print head may be disabled. Additionally or alternately, existence of a required or desired coating or finish may be used as a condition precedent to enabling printing via one or more associated thermal print heads.

Additionally, in some embodiments, a first and a second thermal print head 710, 720, 810, 815, 910, 915, 1110, 1115, 1310, 1315, 1410, 1415 of a two-sided thermal printer 700, 800, 900, 1100, 1300, 1400 may operate at different temperatures (e.g., T1>T2), and/or may operate at any of a range of temperatures (e.g., T1, T2, T3, . . . Tn) and thereby be operated at different temperatures (e.g., Tn>T2). Such design or operation may be required or desired for imaging of, for example, one or more thermally sensitive coatings associated with a first and/or a second media side having different activation temperatures, and/or to print with a thermal transfer ribbon having one or more functional coatings which are adapted to be applied at one or more temperatures, and the like.

Figure 17:
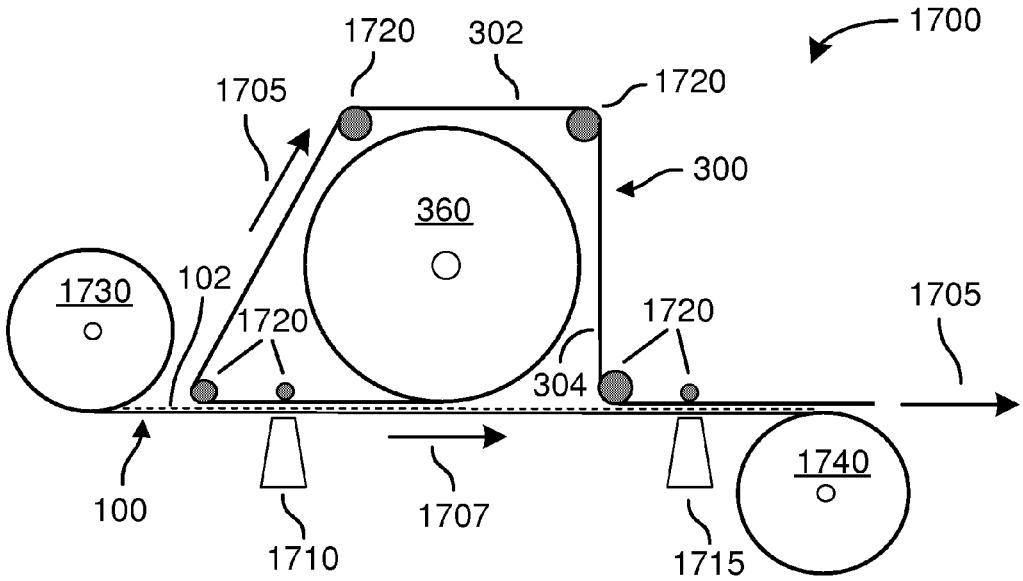
FIG. 17 provides a fifth schematic of a two-sided thermal transfer printer.

Further, in some embodiments, one- or two-sided thermal media 200, 300, 400, 500, 1600 may be rerouted in a two-sided thermal printer such that both sides 202, 204, 302, 304, 402, 404, 502, 504, 1602, 1604 thereof may be simultaneously or near simultaneously printed via respective ones of a first and a second thermal print head positioned on a same side of a direct thermal and/or thermal transfer printer. For example, as shown in FIG. 17, a media feed path 1705 of a two-sided thermal transfer printer 1700 may be oriented such that two-sided thermal transfer media 300 fed from a roll 360 thereof is routed to traverse a first thermal print head 1710 located on a first side of a thermal transfer ribbon 100 feed path 1707 using one or more rollers and/or platens 1720 to a second thermal print head 1715 located on the same (first) side of the ribbon feed path 1707 for near simultaneous thermal transfer printing of both a first and a second side 302, 304 of the media 300 via a functional coating 120 on a first side 102 of a single-sided thermal transfer ribbon 100 fed via respective feed 1730 and take-up 1740 rollers or supports (e.g., spindles).

Figure 18:
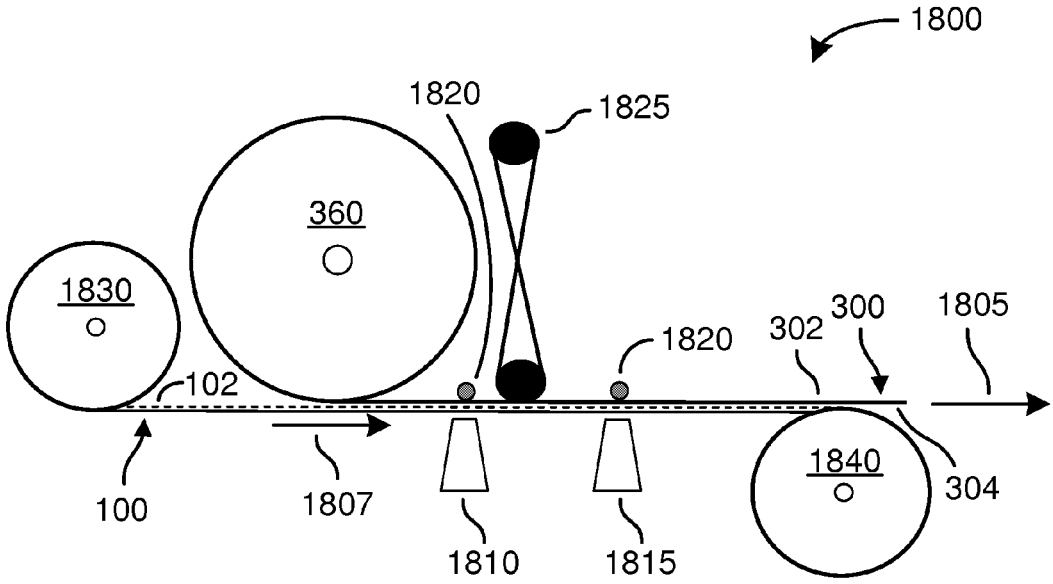
FIG. 18 provides a sixth schematic of a two-sided thermal transfer printer.

Alternately or additionally, as shown in FIG. 18, a media feed path 1805 of a two-sided thermal transfer printer 1800 may be oriented such that two-sided thermal transfer media 300 fed from a roll 360 thereof is routed to traverse a first thermal print head 1810 located on a first side of a thermal transfer ribbon 100 feed path 1807 using one or more rollers and/or platens 1820 and turn bars 1825 to a second thermal print head 1815 located on the same (first) side of the ribbon feed path 1807 for near simultaneous thermal transfer printing of both a first and a second side 302, 304 of the media 300 via a functional coating 120 on a first side 102 of a single-sided thermal transfer ribbon 100 fed via respective feed 1830 and take-up 1840 rollers or supports (e.g., spindles).

A controller (not shown) comprising one or more of a communication controller, one or more memory or buffer elements, a processor, and a printing function switch, as well as various sensors (not shown), as described hereinabove, may be provided with either or both of the two-sided thermal transfer printers 1700, 1800 of FIGS. 17 and 18. Likewise, in alternate embodiments, similar components and/or arrangements (e.g., media turning means comprising one or more rollers, platens, and/or turn bars for printing of two media sides by thermal print heads on a same printer side) may be used in a two-sided direct thermal printer and/or a combined two-sided direct thermal and thermal transfer printer, with or without associated controllers and sensors.

Further, in some embodiments, a first and a second thermal print head 710, 720, 810, 815, 910, 915, 1110, 1115, 1310, 1315, 1410, 1415 of a two-sided thermal printer 700, 800, 900, 1100, 1300, 1400 may directly oppose one another on opposite sides of a media and/or thermal transfer ribbon feed path such that a first thermal print head 710, 810, 910, 1110, 1310, 1410 acts as a platen for a second thermal print head 720, 815, 915, 1115, 1315, 1415 and vice-versa, as further described in U.S. patent application Ser. No. 11/678,216 entitled "Two-Sided Thermal Print Configurations" and filed on Feb. 23, 2007 the contents of which are hereby incorporated by reference herein.

The above description is illustrative, and not restrictive. In particular, designation of a first and a second print head, platen, gear, and the like, as well as a first and second media and/or thermal transfer ribbon sides, and the like, may vary among embodiments.

Further, many other embodiments will be apparent to those of skill in the art upon reviewing the above description. The scope of the embodiments should therefore be determined with reference to the appended claims, along with the full scope of equivalents to which such claims are entitled.

In the foregoing description of the embodiments, various features are grouped together in a single embodiment for the purpose of streamlining the disclosure. Likewise, various features are described only with respect to a single embodiment in order to avoid undue repetition. This method of disclosure is not to be interpreted as reflecting that the claimed embodiments should have more or less features than are expressly recited in each claim. Rather, as the claims reflect, inventive subject matter lies in more or less than all features of a single disclosed embodiment. Thus the claims are hereby incorporated into the description of the embodiments, with each claim standing on its own as a separate exemplary embodiment.

What is claimed is:

1. Two-sided thermal media comprising:
- a substrate having a first side and a second side, opposite the first side;
- a first thermal transfer receptive coating supported on the first side of the substrate;
- a second thermal transfer receptive coating supported on the second side of the substrate;
- a direct thermally sensitive coating supported on the first side of the substrate and disposed on the first thermal transfer receptive coating;
- thermal transfer print applied to a first region of the direct thermally sensitive coating; and
- direct thermal print imaged in a second region of the direct thermally sensitive coating, wherein the second region is other than the first region in which the thermal transfer print was applied.

2. The two-sided thermal media of claim 1, wherein the direct thermal print in the second region was imaged at a temperature different from the temperature at which the thermal transfer print was applied.

3. The two-sided thermal media of claim 2, wherein the thermal transfer print in the first region was applied at a temperature 20 to 80 degrees Celsius greater than the temperature at which the direct thermal print in the second region was imaged.

4. The two-sided thermal media of claim 3, wherein the thermal transfer print in the first region was applied at a temperature 30 to 50 degrees Celsius greater than the temperature at which the direct thermal print in the second region was imaged.

5. The two-sided thermal media of claim 2, wherein the thermal transfer print in the first region was applied at a temperature in the range of 100 to 150 degrees Celsius and the direct thermal print in the second region was imaged at a temperature in the range of 50 to 100 degrees Celsius.

6. The two-sided thermal media of claim 5, wherein the thermal transfer print in the first region was applied at a temperature in the range of 100 to 120 degrees Celsius and the direct thermal print in the second region was imaged at a temperature in the range of 60 to 80 degrees Celsius.

7. The two-sided thermal media of claim 1, wherein the direct thermal print in the second region was imaged at a temperature below that at which the thermal transfer print was capable of having been applied.

8. The two-sided thermal media of claim 1, wherein the thermal transfer print applied to the first region was applied without imaging the direct thermally sensitive coating in the first region.

9. The two-sided thermal media of claim 8, wherein the thermal transfer print applied to the first region was applied at a temperature different from the temperature at which the direct thermal print was imaged in the second region.

10. The two-sided thermal media of claim 9, wherein the direct thermal print was imaged in the second region at a temperature 20 to 80 degrees Celsius greater than the temperature at which the thermal transfer print was applied to the first region without imaging the direct thermally sensitive coating in the first region.

11. The two-sided thermal media of claim 10, wherein the direct thermal print was imaged in the second region at a temperature 30 to 50 degrees Celsius greater than the temperature at which the thermal transfer print was applied to the first region without imaging the direct thermally sensitive coating in the first region.

12. The two-sided thermal media of claim 10, wherein the direct thermal print was imaged in the second region at a temperature in the range of 100 to 150 degrees Celsius and the thermal transfer print applied to the first region was applied at a temperature in the range of 60 to 110 degrees Celsius.

13. The two-sided thermal media of claim 12, wherein the direct thermal print was imaged in the second region at a temperature in the range of 100 to 120 degrees Celsius and the thermal transfer print applied to the first region was applied at a temperature in the range of 70 to 90 degrees Celsius.

14. The two-sided thermal media of claim 8, wherein the thermal transfer print applied to the first region was applied at a temperature below that at which the direct thermally sensitive coating is capable of being imaged.

15. Two-sided thermal media comprising:
- a substrate having a first side and a second side, opposite the first side;
- a direct thermally sensitive coating supported on the first side of the substrate;
- a first thermal transfer receptive coating supported on the first side of the substrate and disposed on the direct thermally sensitive coating;
- a second thermal transfer receptive coating supported on the second side of the substrate;
- thermal transfer print applied to a first region of the first thermal transfer receptive coating; and
- direct thermal print imaged in a second region of the first thermal transfer receptive coating, wherein the second region is other than the first region in which the thermal transfer print was applied.

16. The two-sided thermal media of claim 15, wherein the direct thermal print in the second region was imaged at a temperature different from the temperature at which the thermal transfer print was applied.

17. The two-sided thermal media of claim 16, wherein the thermal transfer print in the first region was applied at a temperature 20 to 80 degrees Celsius greater than the temperature at which the direct thermal print in the second region was imaged.

18. The two-sided thermal media of claim 17, wherein the thermal transfer print in the first region was applied at a temperature 30 to 50 degrees Celsius greater than the temperature at which the direct thermal print in the second region was imaged.

19. The two-sided thermal media of claim 16, wherein the thermal transfer print in the first region was applied at a temperature in the range of 100 to 150 degrees Celsius and the direct thermal print in the second region was imaged at a temperature in the range of 50 to 100 degrees Celsius.

20. The two-sided thermal media of claim 19, wherein the thermal transfer print in the first region was applied at a temperature in the range of 100 to 120 degrees Celsius and the direct thermal print in the second region was imaged at a temperature in the range of 60 to 80 degrees Celsius.

21. The two-sided thermal media of claim 15, wherein the direct thermal print in the second region was imaged at a temperature below that at which the thermal transfer print was capable of having been applied.

22. The two-sided thermal media of claim 15, wherein the thermal transfer print applied to the first region was applied without imaging the direct thermally sensitive coating in the first region.

23. The two-sided thermal media of claim 22, wherein the thermal transfer print applied to the first region was applied at a temperature different from the temperature at which the direct thermal print was imaged in the second region.

24. The two-sided thermal media of claim 23, wherein the direct thermal print was imaged in the second region at a temperature 20 to 80 degrees Celsius greater than the temperature at which the thermal transfer print was applied to the first region without imaging the direct thermally sensitive coating in the first region.

25. The two-sided thermal media of claim 24, wherein the direct thermal print was imaged in the second region at a temperature 30 to 50 degrees Celsius greater than the temperature at which the thermal transfer print was applied to the first region without imaging the direct thermally sensitive coating in the first region.

26. The two-sided thermal media of claim 23, wherein the direct thermal print was imaged in the second region at a temperature in the range of 100 to 150 degrees Celsius and the thermal transfer print applied to the first region was applied at a temperature in the range of 60 to 110 degrees Celsius.

27. The two-sided thermal media of claim 26, wherein the direct thermal print was imaged in the second region at a temperature in the range of 100 to 120 degrees Celsius and the thermal transfer print applied to the first region was applied at a temperature in the range of 70 to 90 degrees Celsius.

28. The two-sided thermal media of claim 22, wherein the thermal transfer print applied to the first region was applied at a temperature below that at which the direct thermally sensitive coating is capable of being imaged.

* * * * *